US011276344B2

(12) United States Patent
Xuan et al.

(10) Patent No.: US 11,276,344 B2
(45) Date of Patent: Mar. 15, 2022

(54) PIXEL CIRCUIT, DRIVING METHOD, AND DISPLAY APPARATUS

(71) Applicant: BOE Technology Group Co., Ltd., Beijing (CN)

(72) Inventors: Minghua Xuan, Beijing (CN); Han Yue, Beijing (CN); Xiaochuan Chen, Beijing (CN); Ning Cong, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 377 days.

(21) Appl. No.: 16/484,087

(22) PCT Filed: Nov. 30, 2018

(86) PCT No.: PCT/CN2018/118635
§ 371 (c)(1),
(2) Date: Aug. 6, 2019

(87) PCT Pub. No.: WO2020/107420
PCT Pub. Date: Jun. 4, 2020

(65) Prior Publication Data

US 2021/0366362 A1 Nov. 25, 2021

(51) Int. Cl.
*G09G 3/32* (2016.01)

(52) U.S. Cl.
CPC ..... *G09G 3/32* (2013.01); *G09G 2300/0426* (2013.01); *G09G 2300/0819* (2013.01);
(Continued)

(58) Field of Classification Search
CPC ..... G09G 3/32; G09G 2330/02; G09G 2300/0426; G09G 2310/0216;
(Continued)

(56) References Cited

U.S. PATENT DOCUMENTS

2010/0164847 A1 7/2010 Lee et al.
2011/0181626 A1 7/2011 Toyomura et al.
2015/0356924 A1* 12/2015 Chen ..... G09G 3/3258 345/690

FOREIGN PATENT DOCUMENTS

CN 102142227 A 8/2011
CN 104050917 A 9/2014
(Continued)

OTHER PUBLICATIONS

International Search Report & Written Opinion dated Jun. 27, 2019, regarding PCT/CN2018/118635.

*Primary Examiner* — Andrew Sasinowski
(74) *Attorney, Agent, or Firm* — Intellectual Valley Law, P.C.

(57) ABSTRACT

The present application discloses a pixel circuit for a light-emitting diode display panel. The pixel circuit includes a reset sub-circuit configured to initialize voltage levels of some nodes. Additionally, the pixel circuit includes a data-input and compensation sub-circuit configured to load a data signal and adjust the voltage levels of the nodes for determining a driving current flown through a driving sub-circuit. The pixel circuit further includes a voltage-control sub-circuit for controlling a switch sub-circuit to determine whether the driving current is flowing or not. Moreover, the pixel circuit includes an emission-control sub-circuit configured to control a partial time span in one scan for passing the driving current to the light-emitting diode to drive light emission. The one scan is one of multiple different scans in one cycle time of displaying one frame of image.

19 Claims, 7 Drawing Sheets

(52) U.S. Cl.
CPC ..... *G09G 2300/0852* (2013.01); *G09G 2310/0216* (2013.01); *G09G 2310/08* (2013.01); *G09G 2330/02* (2013.01)

(58) Field of Classification Search
CPC ... G09G 2300/0852; G09G 2300/0819; G09G 2310/08
See application file for complete search history.

(56) References Cited

FOREIGN PATENT DOCUMENTS

| | | | |
|---|---|---|---|
| CN | 106920508 | A | 7/2017 |
| CN | 108538241 | A | 9/2018 |
| CN | 108877668 | A | 11/2018 |

* cited by examiner

PIXEL CIRCUIT, DRIVING METHOD, AND DISPLAY APPARATUS

CROSS-REFERENCE TO RELATED APPLICATION

This application is a national stage application under 35 U.S.C. § 371 of International Application No. PCT/CN2018/118635, filed Nov. 30, 2018, the contents of which are incorporated by reference in the entirety.

TECHNICAL FIELD

The present invention relates to display technology, more particularly, to a pixel circuit, a driving method, and a display apparatus.

BACKGROUND

Micro light-emitting diode (μLED) based on Gallium Nitride material has advantages in low driving voltage and long working life span. It has gradually been applied for the display panel for applications in consumer product terminals. While most display panels are preferred to be made on glass substrates, the μLED based display panel is still not well developed particularly in its pixel circuit design and driving method.

It is desired to provide improved pixel circuit and corresponding driving method for the μLED display panel based on glass substrate.

SUMMARY

In an aspect, the present disclosure provides a pixel circuit for light-emitting diode display panel. The pixel circuit includes a voltage-control sub-circuit configured to set a voltage level for a third node based on an emission-drive signal under control of a gate-control signal. Additionally, the pixel circuit includes a pixel sub-circuit coupled respectively to a first voltage supply and a data line to generate a driving current flown from the first voltage supply along a path via a first terminal to a second terminal, the path being opened from the first voltage supply to the first terminal by the voltage level at the third node. Furthermore, the pixel circuit includes an emission-control sub-circuit configured to set a time span of passing the driving current from the second terminal to a light-emitting diode under control of an emission-control signal in each of multiple scans of each cycle for displaying one frame of image.

Optionally, the pixel sub-circuit includes a reset sub-circuit coupled to the first voltage supply and a second voltage supply to initialize voltage levels at a first node, a second node, and the third node under control of a reset signal. The pixel sub-circuit further includes a data-input-compensation sub-circuit coupled to the first node and the second node to set the voltage level at the second node based a data signal received from the data line under control of a gate-control signal provided in each of the multiple scans and adjust the voltage level at the first node based on the voltage level at the second node. Additionally, the pixel sub-circuit includes a switch sub-circuit coupled to the first voltage supply and a first terminal. The switch sub-circuit is configured to turn ON or OFF for opening the path to connect the first voltage supply to the first terminal under control of the voltage level at the third node. Furthermore, the pixel sub-circuit includes a driving sub-circuit coupled between the first terminal and the second terminal and configured to determine the driving current from the first terminal to the second terminal under control of the voltage level of the first node.

Optionally, the pixel sub-circuit further includes a storage sub-circuit coupled between the first node and the second node. The storage sub-circuit includes a storage capacitor having a first electrode coupled to the first node and a second electrode coupled to the second node.

Optionally, the driving sub-circuit includes a driving transistor having a source electrode being the first terminal, a gate electrode coupled to the first node, and a drain electrode being the second terminal.

Optionally, the reset sub-circuit includes a first transistor having a source electrode coupled to the first node, a gate electrode coupled to a reset terminal to receive the reset signal in a reset period of each of the multiple scans, and a drain electrode coupled to the second voltage supply. The reset sub-circuit also includes a fifth transistor having a source electrode coupled to the first voltage supply, a gate electrode coupled to the reset terminal, and a drain electrode coupled to the second node. The reset sub-circuit further includes a tenth transistor having a source electrode coupled to the third node, a gate electrode coupled to the reset terminal, and a drain electrode coupled to the second voltage supply.

Optionally, the data-input-compensation sub-circuit includes a second transistor having a source electrode coupled to the first node, a gate electrode coupled to a first scan line to receive the gate-driving signal in a data-input-compensation period of each of the multiples, and a drain electrode coupled to the second terminal. The data-input-compensation sub-circuit further includes a fourth transistor having a source electrode coupled to the second node, a gate electrode coupled to the first scan line, and a drain electrode coupled to a data line provided with the data signal at least in the data-input-compensation period. The second transistor is configured to set the voltage level at the first node to be equal to that at the drain electrode of the driving sub-circuit. The fourth transistor is configured to change the voltage level at the second node to that of the data signal received in the data-input-compensation period.

Optionally, the voltage-control sub-circuit includes a ninth transistor having agate electrode coupled to a second scan line to receive the gate-control signal in an emission-voltage setting period of each of the multiple scans, a source electrode coupled to an emission-drive terminal to receive the emission-drive signal, and a drain electrode coupled to the third node. The ninth transistor is configured to write a voltage level of the emission-drive signal to the third node during the emission-voltage setting period.

Optionally, the switch sub-circuit includes an eighth transistor having a source electrode coupled to the first voltage supply, a gate electrode coupled to the third node, and a drain electrode coupled to the first terminal. The eighth transistor is configured, during the emission-voltage setting period, to either connect the source electrode of the driving transistor to the first voltage supply when the third node is at a turn-on voltage level passed from the emission-drive signal or disconnect the source electrode of the driving transistor from the first voltage supply when the third node is at a turn-off voltage level passed from the emission-drive signal.

Optionally, the pixel sub-circuit further includes a capacitor coupled between the third node and the first voltage supply, the capacitor being configured to stabilize the voltage level at the third node at least in an emission period of each of the multiple scans after the emission-voltage setting period.

Optionally, the emission-control sub-circuit includes a seventh transistor having a source electrode coupled to the second terminal of the driving sub-circuit, a gate electrode coupled to a third scan line to receive the emission-control signal in the emission period of each of the multiple scans, and a drain electrode coupled to an anode of the light-emitting diode. The seventh transistor is configured to pass the driving current from the drain electrode of the driving transistor to the light-emitting diode during the emission period in the time span set by the emission-control sub-circuit based on the emission-control signal.

Optionally, the emission-control sub-circuit further includes a sixth transistor having a source electrode coupled to the first voltage supply, a gate electrode coupled to the third scan line, and a drain electrode coupled to the second node. The sixth transistor is configured to change the voltage level at the second node to a fixed voltage from the first voltage supply so that the voltage level at the first node is changed for determining the driving current during the emission period of each of the multiple scans.

Optionally, the multiple scans in one cycle of displaying one frame of image include N numbers of scans, N being an integer greater than 1. Each of the N numbers of scans includes sequentially a reset period, a data-input-compensation period, an emission-voltage setting period, and an emission period. N different emission periods of respective N numbers of scans have N numbers of different time spans each of which being sequentially arranged from one unit of time to $2^{N-1}$ units of time of a binary multiplication series. A sum of the N numbers of different time spans of all emission periods of the N numbers of scans is no greater than one cycle for displaying one frame of image.

Optionally, the pixel sub-circuit includes a driving transistor having a source electrode coupled to a first terminal, a gate electrode coupled to a first node, and a drain electrode coupled to a second terminal and a storage capacitor having a first electrode coupled to the first node and a second electrode coupled to a second node. The pixel sub-circuit further includes a first transistor having a source electrode coupled to the first node, a gate electrode coupled to a reset terminal to receive a reset signal in a reset period of each of the multiple scans in one cycle for displaying one frame of image, and a drain electrode coupled to a second voltage supply. Additionally, the pixel sub-circuit includes a second transistor having a source electrode coupled to the first node, a gate electrode coupled to a first scan line to receive a gate-driving signal in a data-input-compensation period of each of the multiple scans in one cycle for displaying one frame of image, and a drain electrode coupled to the second terminal. The pixel sub-circuit also includes a fourth transistor having a source electrode coupled to the second node, a gate electrode coupled to a first scan line, and a drain electrode coupled to a data line provided with a data signal at least in the data-input and compensation period. The pixel sub-circuit further includes a fifth transistor having a source electrode coupled to a first voltage supply provided with a fixed high voltage, a gate electrode coupled to the reset terminal, and a drain electrode coupled to the second node. Furthermore, the pixel sub-circuit includes an eighth transistor having a source electrode coupled to the first voltage supply, a gate electrode coupled to the third node, and a drain electrode coupled to the first terminal. Moreover, the pixel sub-circuit includes a tenth transistor having a source electrode coupled to the third node, a gate electrode coupled to the reset terminal, and a drain electrode coupled to the second voltage supply provided with a fixed initializing voltage.

Optionally, The voltage-control sub-circuit includes a ninth transistor having a gate electrode coupled to a second scan line to receive a gate-control signal in an emission-voltage setting period of each one of the multiple scans in one cycle for displaying one frame of image, a source electrode coupled to an emission-drive terminal to receive an emission-drive signal, and a drain electrode coupled to the third node.

Optionally, the emission-control sub-circuit includes a sixth transistor having a source electrode coupled to the first voltage supply, a gate electrode coupled to a third scan line to receive an emission-control signal in an emission period of each one of the multiple scans in one cycle for displaying one frame of image, and a drain electrode coupled to the second node. The emission-control sub-circuit also includes a seventh transistor having a source electrode coupled to the drain electrode of the driving transistor, a gate electrode coupled to the third scan line, and a drain electrode coupled to an anode of the light-emitting diode. Optionally, each transistor herein is a P-type transistor.

Optionally, the pixel sub-circuit includes a driving transistor having a drain electrode coupled to a first terminal, a gate electrode coupled to the first node, and a source electrode coupled to a second node being also a second terminal. The pixel-sub-circuit further includes a first storage capacitor having a first electrode coupled to the first node and a second electrode coupled to the second node. The pixel sub-circuit also includes a first transistor having a drain electrode coupled to the first node, a gate electrode coupled to a reset terminal to receive a reset signal in a reset period of each of the multiple scans in one cycle for displaying one frame of image, and a source electrode coupled to the second voltage supply. Additionally, the pixel sub-circuit includes a fourth transistor having a drain electrode coupled to the second node, a gate electrode coupled to the first scan line, and a source electrode coupled to the data line provided with a data signal at least in a data-input-compensation period of each of the multiple scans in one cycle for displaying one frame of image. The pixel sub-circuit also includes a sixth transistor having a drain electrode coupled to the third voltage supply, a gate electrode coupled to the reset terminal to receive the reset signal in the reset period of each of the multiple scans in one cycle for displaying one frame of image, and a source electrode coupled to the third node. Furthermore, the pixel sub-circuit includes a seventh transistor having a drain electrode coupled to the first voltage supply, a gate electrode coupled to the third node, and a source electrode coupled to the first terminal. Moreover, the pixel sub-circuit includes a second storage capacitor having a first electrode coupled to the first terminal and a second electrode coupled to the first node and a third storage capacitor having a first electrode coupled to the first voltage supply and a second electrode coupled to the third node. The emission-control sub-circuit includes a second transistor having a drain electrode coupled to the second node, a gate electrode coupled to the third scan line to receive an emission-control signal in an emission period of each of the multiple scans in one cycle for displaying one frame of image, and a source electrode coupled to the light-emitting diode. The voltage-control sub-circuit includes a fifth transistor having a drain electrode coupled to an emission-drive terminal to receive an emission-drive signal, a gate electrode coupled to the second scan line to receive a gate-control signal in an emission-voltage setting period of each one of the multiple scans in one cycle for displaying one frame of image, and a source electrode coupled to the third node. Each transistor herein is an N-type transistor.

In another aspect, the present disclosure provides a display apparatus including a display panel having a plurality of pixels. Each of a plurality of pixels includes a light-emitting diode driven by a pixel circuit described herein to emit light in multiple scans of each cycle for displaying one frame of image.

Optionally, the display apparatus further includes a first scan line, a second scan line, a third scan line, a data line, a first voltage supply, and a second voltage supply. The pixel circuit includes a driving transistor having a source electrode coupled to a first terminal, a gate electrode coupled to the first node, and a drain electrode coupled to a second terminal. The pixel circuit also includes a storage capacitor having a first electrode coupled to the first node and a second electrode coupled to a second node. The pixel circuit further includes a first transistor having a source electrode coupled to the first node, a gate electrode coupled to a reset terminal to receive a reset signal in a reset period of each of the multiple scans in one cycle for displaying one frame of image, and a drain electrode coupled to the second voltage supply. Additionally, the pixel circuit includes a second transistor having a source electrode coupled to the first node, a gate electrode coupled to the first scan line to receive a gate-driving signal in a data-input-compensation period of each of the multiple scans in one cycle for displaying one frame of image, and a drain electrode coupled to the second terminal. The pixel circuit further includes a fourth transistor having a source electrode coupled to the second node, a gate electrode coupled to the first scan line, and a drain electrode coupled to the data line provided with a data signal at least in the data-input and compensation period. Furthermore, the pixel circuit includes a fifth transistor having a source electrode coupled to the first voltage supply provided with a fixed high voltage, a gate electrode coupled to the reset terminal, and a drain electrode coupled to the second node. The pixel circuit also includes a sixth transistor having a source electrode coupled to the first voltage supply, a gate electrode coupled to the third scan line to receive an emission-control signal in an emission period of each one of the multiple scans in one cycle for displaying one frame of image, and a drain electrode coupled to the second node. The pixel circuit further includes a seventh transistor having a source electrode coupled to the drain electrode of the driving transistor, a gate electrode coupled to the third scan line, and a drain electrode coupled to an anode of the light-emitting diode. Furthermore, the pixel circuit includes an eighth transistor having a source electrode coupled to the first voltage supply, a gate electrode coupled to the third node, and a drain electrode coupled to the first terminal. The pixel circuit further includes a ninth transistor having a gate electrode coupled to a second scan line to receive a gate-control signal in an emission-voltage setting period of each one of the multiple scans in one cycle for displaying one frame of image, a source electrode coupled to an emission-drive terminal to receive an emission-drive signal, and a drain electrode coupled to the third node. Moreover, the pixel circuit includes a tenth transistor having a source electrode coupled to the third node, a gate electrode coupled to the reset terminal, and a drain electrode coupled to the second voltage supply provided with a fixed initializing voltage. Each transistor herein is a P-type transistor.

Optionally, the pixel circuit further includes a capacitor coupled between the first voltage supply and the third node for stabilizing a voltage level at the third node when the ninth transistor and the tenth transistor are turned off.

Optionally, the display apparatus includes a first scan line, a second scan line, a third scan line, a data line, a first voltage supply, a second voltage supply, a third voltage supply. The pixel circuit includes a driving transistor having a drain electrode coupled to a first terminal, a gate electrode coupled to the first node, and a source electrode coupled to a second node being also a second terminal. The pixel circuit further includes a first storage capacitor having a first electrode coupled to the first node and a second electrode coupled to the second node. The pixel circuit also includes a first transistor having a drain electrode coupled to the first node, a gate electrode coupled to a reset terminal to receive a reset signal in a reset period of each of the multiple scans in one cycle for displaying one frame of image, and a source electrode coupled to the second voltage supply. Additionally, the pixel circuit includes a second transistor having a drain electrode coupled to the second node, a gate electrode coupled to the third scan line to receive an emission-control signal in an emission period of each of the multiple scans in one cycle for displaying one frame of image, and a source electrode coupled to the light-emitting diode. The pixel circuit further includes a fourth transistor having a drain electrode coupled to the second node, a gate electrode coupled to the first scan line, and a source electrode coupled to the data line provided with a data signal at least in a data-input-compensation period of each of the multiple scans in one cycle for displaying one frame of image. Furthermore, the pixel circuit includes a fifth transistor having a drain electrode coupled to an emission-drive terminal to receive an emission-drive signal, a gate electrode coupled to the second scan line to receive a gate-control signal in an emission-voltage setting period of each one of the multiple scans in one cycle for displaying one frame of image, and a source electrode coupled to the third node. The pixel circuit further includes a sixth transistor having a drain electrode coupled to the third voltage supply, a gate electrode coupled to the reset terminal to receive the reset signal in the reset period of each of the multiple scans in one cycle for displaying one frame of image, and a source electrode coupled to the third node. Moreover, the pixel circuit includes a seventh transistor having a drain electrode coupled to the first voltage supply, a gate electrode coupled to the third node, and a source electrode coupled to the first terminal. The pixel circuit also includes a second storage capacitor having a first electrode coupled to the first terminal and a second electrode coupled to the first node and a third storage capacitor having a first electrode coupled to the first voltage supply and a second electrode coupled to the third node. Each transistor herein is an N-type transistor.

In yet another aspect, the present disclosure provides a method for driving the pixel circuit described herein in a light-emitting diode display panel. The method includes applying a gate-control signal to a second scan line to control an emission-drive signal being loaded to set a voltage at a third node for determining whether a path is open from a first voltage supply to a first terminal. Additionally, the method includes applying a gate-driving signal to a first scan line to control a data signal being loaded from a data line for setting a voltage level of a first node to determine a driving current flowing from the first terminal to a second terminal. Furthermore, the method includes applying an emission-control signal to a third scan line to control a partial time span in each scan of multiple scans in the one cycle to pass the driving current from the second terminal to a light-emitting diode to drive the light-emitting diode to emit light only in the partial time span in each scan. Different scans of the multiple scans constitute different partial time spans arranged for quantifying a pixel luminance cumulated in the one cycle.

Optionally, the method further includes resetting voltage levels at a first node, a second node, and a third node to initialize the voltage level at the control terminal directly through the first node and the voltage level of the first terminal indirectly through the third node in a reset period of each scan of the multiple scans before applying a gate-driving signal to the first scan line to load the data signal directly from the data line to the second node to adjust the voltage level at the control terminal and to connect the first node to the second terminal.

Optionally, the step of applying an emission-control signal includes supplying a turn-on voltage to load the emission-drive signal at either a turn-on voltage or a turn-off voltage to the third node in an emission-voltage setting period after the data-input-compensation period of each scan. The emission-drive signal at the turn-on voltage determines the path is open for the driving current flowing to the second terminal or the emission-drive signal at the turn-off voltage determines the driving current is zero.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

Micro light-emitting diode (μLED) display panel based on glass substrate needs many improvements in pixel circuit design and driving method thereof. Accordingly, the present disclosure provides, inter alia, a pixel circuit for a μLED display panel based on the glass substrate, a display panel and a display apparatus having the same, and a driving method thereof that substantially obviate one or more of the problems due to limitations and disadvantages of the related art.

In one aspect, the present disclosure provides a pixel circuit for each pixel implemented in a light-emitting diode (LED) display panel. Optionally, the LED is a micro LED (μLED) based on gallium nitride material, although the pixel circuit provided herein does not have limitation on types of LEDs. Optionally, the display panel is developed on a glass substrate. Particularly, the pixel circuit, as it is built in one of a plurality of pixels in the display panel, is also fabricated on the glass substrate, although the circuit itself disclosed herein does not have limitation on types of materials of the substrate for fabricating each component in the pixel circuit as well as the light-emitting diode driven by the pixel circuit.

Figure 1:
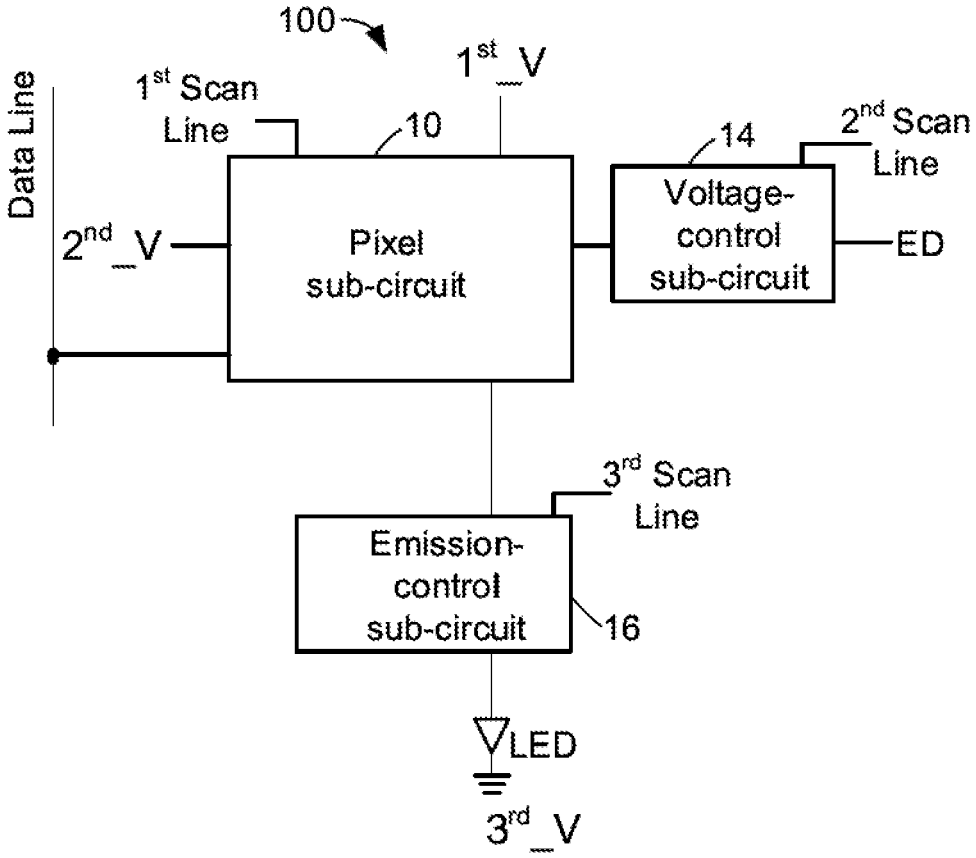
FIG. 1 is a block diagram of a pixel circuit for a light-emitting diode display panel according to some embodiments of the present disclosure.

FIG. 1 is a block diagram of a pixel circuit for a light-emitting diode display panel according to some embodiments of the present disclosure. Referring to FIG. 1, the pixel circuit 100 includes a pixel sub-circuit 10 coupled at least to a first voltage supply ($1^{st}$_V), a second voltage supply ($2^{nd}$_V), a first scan line, and a data line. The pixel circuit 100 further includes a voltage-control sub-circuit 14 coupled to the pixel sub-circuit 10, and also coupled to a second scan line and an emission-drive terminal (ED). Furthermore, the pixel circuit 100 includes an emission-control sub-circuit 16 coupled to the pixel sub-circuit 10, and also coupled to a third scan line and a light-emitting device (LED). In an embodiment, the voltage-control sub-circuit 14 is configured to set a voltage level for a third node (coupled to the pixel sub-circuit 10, but not shown in FIG. 1) based on an emission-drive signal received from the emission-drive terminal ED under control of a gate-control signal received from the second scan line. In the embodiment, the pixel sub-circuit 10 is coupled respectively to the first voltage supply ($1^{st}$_V) to receive a first voltage (usually a power supply voltage VDD) and the data line to receive a data signal related to image data. The pixel sub-circuit 10 is configured to generate a driving current based on the data signal and create a path for the driving current to flow from the first voltage supply along the path via a first terminal to a second terminal. In the embodiment, the path is opened from the first voltage supply to the first terminal by the voltage level set at the third node. In the embodiment, the emission-control sub-circuit 16 is configured to set a time span of passing the driving current from the second terminal to a light-emitting diode (LED) under control of an emission-control signal from the third scan line. The pixel circuit is configured to be operated in cycles for one frame of image after another. And particularly each cycle includes multiple scans each of which the pixel circuit is driven to produce a driving current in corresponding different time span determined by the emission-control sub-circuit 16 to drive the LED to emit light with different pixel luminance.

Figure 2:
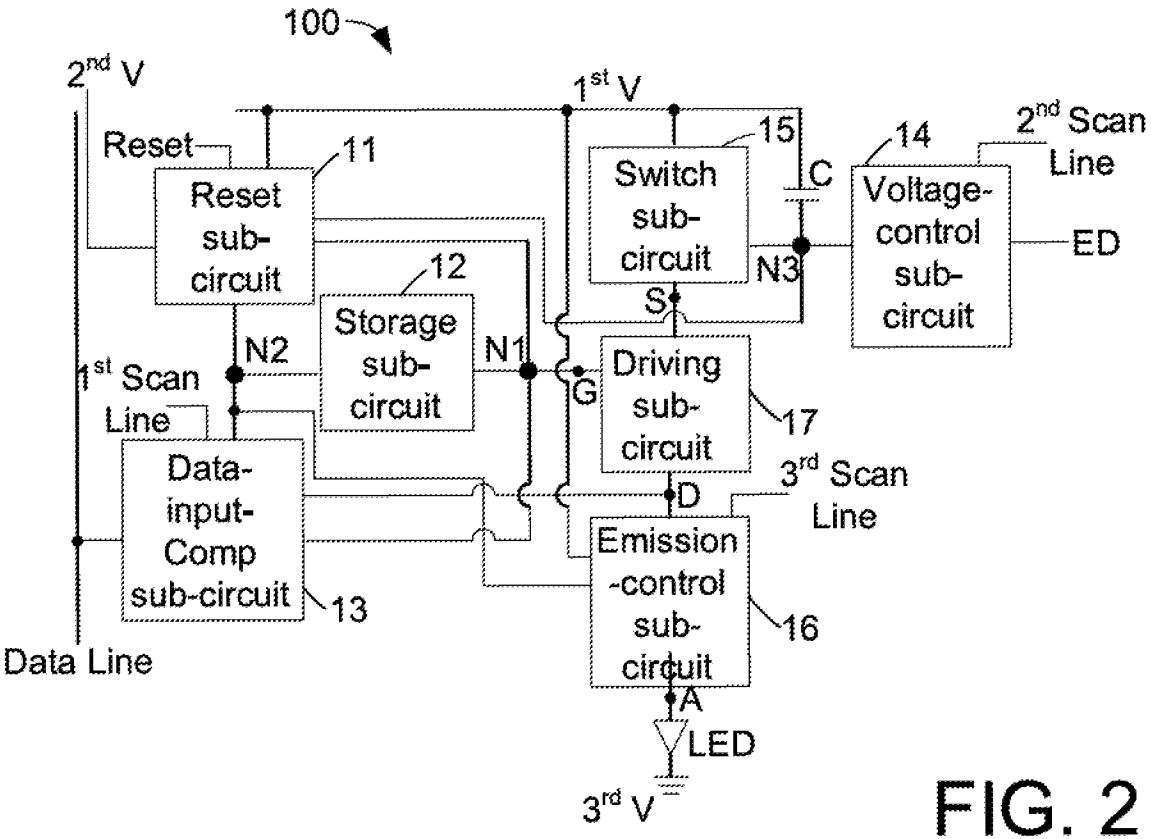
FIG. 2 is a block diagram of a pixel circuit for a light-emitting diode display panel according to an embodiment of the present disclosure.

FIG. 2 is a block diagram of a pixel circuit for a light-emitting diode display panel according to an embodiment of the present disclosure. Referring to FIG. 2, the pixel circuit 100 includes a reset sub-circuit 11, a storage sub-circuit 12, a data-input-compensation sub-circuit 13, a voltage-control sub-circuit 14, a switch sub-circuit 15, an emission-control sub-circuit 16, and a driving sub-circuit 17. These sub-circuits are coupled internally to each other primarily through three nodes, a first node N1, a second node N2, and a third node N3, and two terminals, a first terminal S and a second terminal D, and coupled externally to a few power supply lines including a first voltage line ($1^{st}$_V), a second voltage line ($2^{nd}$_V), and a third voltage line ($3^{rd}$_V).

Optionally, the first voltage line is a power supply VDD for the circuit. Optionally, the third voltage line ($3^{rd}$_V) is ground or set to a low voltage VSS. Optionally, the second voltage line ($2^{nd}$_V) is provided with a reference voltage. Further, some of the sub-circuits are configured to receive several control signals including a reset signal via a reset terminal Reset, a data signal from a data line, a gate-driving signal from a first scan line, a gate-control signal from a second scan line, an emission-control signal from a third scan line, and an emission-drive signal from an emission-drive terminal ED. Additionally, the pixel circuit 100 is coupled to an anode of a light-emitting diode (LED) via the emission-control sub-circuit 16, where the LED has a cathode coupled to the third voltage line ($3^{rd}$_V) or been grounded. Optionally, the LED is a micro LED.

In some embodiments, the driving sub-circuit 17 is configured to determine a driving current from the first terminal S thereof to the second terminal D thereof under control of a voltage level of a control terminal G which is coupled to the first node N1 to control a generation of a driving current flowing from the first terminal S to the second terminal D. The first terminal S is coupled to the switch sub-circuit 15. The second terminal D is coupled to both the data-input-compensation sub-circuit 13 and the emission-control sub-circuit 16. The control terminal G is coupled to the storage sub-circuit 12, the reset sub-circuit 11, and the data-input-compensation sub-circuit 13, respectively.

Referring to FIG. 2, the reset sub-circuit 11 is coupled to the first voltage line ($1^{st}$_V) and a second voltage line ($2^{nd}$_V) and is configured to initialize voltage levels at the first node N1, the second node N2, and the third node N3 under control of the reset signal received from the reset terminal Reset. Optionally, the reset terminal Reset is connected to a controller associated with a peripheral operation system of the display panel that provides clock signals, all control signals, and multiple voltage supplies for the first voltage line $1^{st}$_V and the second voltage line $2^{nd}$_V. Optionally, the control signals, including at least the gate-driving signal from the first scan line Gate, the gate-control signal from the second scan line EG, and the emission-control signal from the third scan line EM, are provided repeatedly in each cycle for displaying one frame of image after another. Optionally, the cycle is further divided into multiple scans. Each scan of the multiple scans may include different operation periods wherein the control signals may be provided differently for performing respective control operations onto the pixel circuit 100. From one scan to next, the control signals may be partially repeated but with different time spans in respective operation periods.

Referring to FIG. 2, the data-input-compensation sub-circuit 13 is coupled to the first node N1 and the second node N2 to set the voltage level at the second node N2 based on a data signal received from the data line and adjust the voltage level at the first node N1 based on the voltage level at the second node N2. Optionally, the storage sub-circuit 12 is coupled between the first node N1 and the second node N2 so that the voltage level at the first node N1 can be associated with the voltage level at the second node N2. The data-input-compensation sub-circuit 13 is controlled by a gate-driving signal received from the first scan line Gate. The first scan line is also connected to the peripheral operation system of the display panel.

Further referring to FIG. 2, the voltage-control sub-circuit 14 is configured to determine the voltage level at the third node N3 based on an emission-drive signal received from an emission-drive terminal ED under control of the gate-control signal from the second scan line EG. Optionally, the emission-drive terminal ED is coupled to the controller and the second scan line is also connected to the peripheral operation system of the display panel.

Furthermore, the switch sub-circuit 15 is coupled to the first voltage line ($1^{st}$_V) and configured to open a path from the first voltage line $1^{st}$_V to the first terminal S under control of the voltage level at the third node N3. The voltage level at the third node N3 is determined either by the reset sub-circuit 11 or by the voltage-control sub-circuit 14, at different operation periods. Optionally, the voltage level at the third node N3 is determined to be a turn-off voltage level that can control the switch sub-circuit 15 to shut off the path so that the first terminal S is floated or the driving sub-circuit 17 is disconnected from first voltage line $1^{st}$ V. Optionally, the voltage level at the third node N3 is determined to be a turn-on voltage level that can control the switch sub-circuit 15 to open the path so that the first terminal S is conducted to the first voltage line ($1^{st}$_V). Optionally, the third node N3 is also indirectly coupled to the first voltage line ($1^{st}$_V) via a capacitor C which plays a role of stabilizing the voltage level thereof after the third node N3 is disconnected from either the reset sub-circuit 11 or the voltage-control sub-circuit 14.

Moreover, the emission-control sub-circuit 16 is coupled to the second terminal D and optionally coupled to an anode of the light-emitting device (LED). The emission-control sub-circuit 16 is configured to control a time span of passing the driving current generated by the driving sub-circuit 17 from the second terminal D to the anode of the light-emitting diode under control of an emission-control signal received from the third scan line EM. Optionally, the time span is duration of an emission period of one scan of the multiple scans in one cycle time of displaying one frame of image. The emission period is just one of several operation periods of one scan. Different scans in one cycle can have different emission periods with different time spans. In other words, the time span of the emission period is how long the LED is driven to emit light by the driving current allowed to pass from the second terminal D to the LED by the emission-control sub-circuit 16. The length of passing the driving current contributes a partial luminance of the pixel associated with the LED driven by the pixel circuit 100 in just one scan. A pixel luminance in each cycle for displaying one frame of pixel image then should be a sum of all partial luminance in respective multiple scans.

Figure 3:
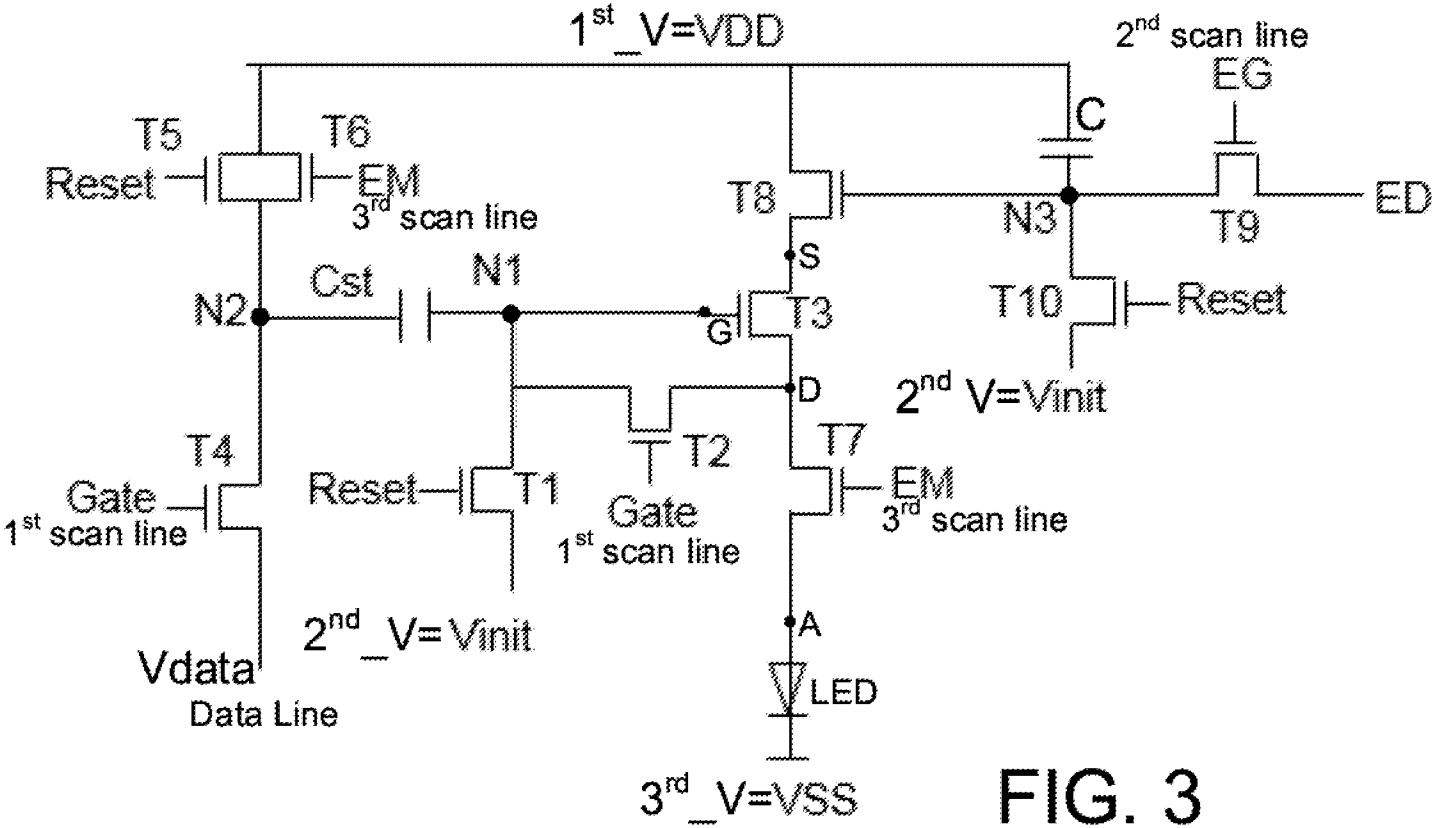
FIG. 3 is an exemplary circuit diagram of the pixel circuit according to an embodiment of the present disclosure.

FIG. 3 is an exemplary circuit diagram of the pixel circuit of FIG. 2 according to an embodiment of the present disclosure. Referring to FIG. 2 and FIG. 3, the storage sub-circuit 12 in the pixel circuit 100 is provided as a storage capacitor Cst having a first electrode coupled to the first node N1 and a second electrode coupled to the second node N2. The driving sub-circuit 17 of the pixel circuit 100 includes a driving transistor T3 having a source electrode coupled to the first terminal S, a gate electrode (served as the control terminal G) connected to the first node N1, and a drain electrode coupled to the second terminal D. Optionally, the driving transistor T3 is a thin-film MOS transistor based on glass substrate having a characterizing threshold voltage Vth that may be different from one pixel to another.

Referring to FIG. 2 and FIG. 3, the reset sub-circuit 11 of the pixel circuit 100 includes a first transistor T1 having a source electrode coupled to the first node N1, a gate electrode coupled to the reset terminal Reset, and a drain electrode coupled to the second voltage line $2^{nd}$_V. The reset terminal Reset is configured to receive the reset signal effective in a reset period of each of the multiple scans to perform one voltage resetting operation for resetting the first node N1 to a voltage level supplied to the second voltage line ($2^{nd}$_V). Here, the second voltage line ($2^{nd}$_V) is supplied with an initializing voltage Vinit. The reset sub-circuit 11 further includes a fifth transistor T5 having a source electrode coupled to the first voltage line, a gate electrode coupled to the reset terminal Reset, and a drain electrode coupled to the second node N2. Here the reset terminal Reset is configured to receive the same reset signal effective in the same reset period to perform another voltage resetting operation for resetting the second node N2 to a voltage level supplied to the first voltage line ($1^{st}$_V). In this example, the $1^{st}$_V is supplied with a fixed high voltage VDD. Additionally, the reset sub-circuit 11 includes a tenth transistor T10 having a source electrode coupled to the third node N3, a gate electrode coupled to the reset terminal Reset, and a drain electrode coupled also to the second voltage line $2^{nd}$_V. The reset terminal Reset is configured to receive the reset signal effective in the same reset period to performing another voltage resetting operation for resetting the third node N3 to a voltage level supplied to the second voltage line $2^{nd}$_V which is the initializing voltage Vinit.

Referring to FIG. 2 and FIG. 3, the data-input-compensation sub-circuit 13 of the pixel circuit 100 includes a second transistor T2 having a source electrode coupled to the first node N1, a gate electrode coupled to a first scanline Gate, and a drain electrode coupled to the second terminal D. Additionally, the data-input-compensation sub-circuit 13 includes a fourth transistor T4 having a source electrode coupled to the second node N2, a gate electrode coupled to the first scan line Gate, and a drain electrode coupled to a data line to receive a data signal Vdata.

In an embodiment, the first scan line Gate is provided with a gate-driving signal effective in a data-input-compensation period of each scan of the multiple scans in one cycle for displaying one frame of image. Optionally, the data-input-compensation period is an operation period subsequently next to the reset period in each scan. While in the same data-input-compensation period the data line can be provided with a data signal Vdata so that the gate-driving signal effective in the data-input-compensation period is a turn-on voltage level, the fourth transistor T4 is turned on to allow the voltage level of the data signal Vdata to be written to the second node N2. In other words, the voltage level at the second node N2, which was initialized to the voltage level VDD during the reset period of the same scan, is changed to the voltage level of the data signal Vdata during the data-input-compensation period.

In the embodiment, the second transistor T2 is configured, under control of the same gate-driving signal from the first scan line Gate, to set the voltage level at the first node N1 to be equal to that at the drain electrode D of the driving transistor T3. In any time, the voltage level at the first node N1 is correlated to the voltage level at the second node N2 due to a coupling via the storage capacitor Cst. The first node N1 is also the gate electrode G of the driving transistor T3. These voltage level settings of the gate electrode and the drain electrode of the driving transistor T3 in association with the loading of the data signal via the data-input and compensation sub-circuit 13 are designed to set the driving transistor T3 to a saturation state.

Referring to FIG. 2 and FIG. 3 again, the voltage-control sub-circuit 14 includes a ninth transistor T9 having a gate electrode coupled to a second scan line EG, a source electrode coupled to an emission-drive terminal ED, and a drain electrode coupled to the third node N3. In the embodiment, the second scan line EG is configured to make the gate-control signal effective in an emission-voltage setting period of each of the multiple scans. Optionally, the emission-drive terminal ED is also supplied with an emission-drive signal effective in the same emission-voltage setting period. As the effective gate-control signal from the second scan line EG is provided as a turn-on voltage level the ninth transistor T9 is turned on so that the voltage level of the emission-drive signal can be written to the third node N3. Optionally, the emission-voltage setting period is set to be subsequent to the data-input and compensation period in each scan. The voltage level at the third node N3 initially was set to the initializing voltage Vinit during the reset period of the same scan. In other words, the voltage level at the third node N3 is configured to be changed from the initializing voltage Vinit to the voltage level defined by the emission-drive signal from the emission-drive terminal ED during the emission-voltage setting period.

In the pixel circuit 100, the switch sub-circuit 15 includes an eighth transistor T8 having a source electrode coupled to the first voltage line $1^{st}$_V=VDD, a gate electrode coupled to the third node N3, and a drain electrode coupled to the first terminal S, which is the source electrode of the driving transistor T3. In the embodiment, the eighth transistor T8 of the switch sub-circuit 15 is used, during the emission-voltage setting period, to either connect the first terminal S to the first voltage line VDD when the third node N3 is written in a turn-on voltage level of the emission-drive signal from the emission-drive terminal ED or disconnect the first terminal S from the first voltage line VDD when the third node N3 is written in a turn-off voltage level of the emission-drive signal from the emission-drive terminal ED. Optionally, whenever a voltage level of the third node N3 is set (either at the turn-on voltage level or the turn-off voltage level), it is stabilized by the capacitor C which connects the third node N3 and the first voltage line VDD, even when the ninth transistor T9 is turned off after the emission-voltage setting period in each scan. Therefore, the switch sub-circuit 15 is ultimately controlled by both the gate-control signal from the second scan line EG and the emission-drive signal from the emission-drive terminal ED to determine whether a path is opened from the first voltage line to the first terminal allowing a current to flow from a high voltage source VDD to a ground (VSS).

Referring to FIG. 2 and FIG. 3, the emission-control sub-circuit 16 of the pixel circuit 100 includes a seventh transistor T7 having a gate electrode coupled to a third scan line EM, a source electrode coupled to the second terminal D, and a drain electrode coupled to an anode of the LED. Additionally, the emission-control sub-circuit 16 further includes a sixth transistor T6 having a source electrode coupled to the first voltage line VDD, a gate electrode coupled to the third scan line EM, and a drain electrode coupled to the second node N2.

In an embodiment, the second terminal D is also the drain electrode of the driving transistor T3. The third scan line EM is configured to receive the emission-control signal being effective in an emission period of each scan of the multiple scans. The emission period is one operation period subsequent to the emission-voltage setting period of the same scan. Alternatively, the sixth transistor T6 is configured, controlled by the emission-control signal from the third scan line EM, to change the voltage level at the second node N2 to the voltage VDD from the first voltage line $1^{st}$_V during the emission period. The change of the voltage level at the second node N2 will then be coupled via the storage capacitor Cst to cause a change of the voltage level at the first node N1, i.e., the gate electrode G of the driving transistor T3, which is responsible for determining the saturation state of the driving transistor T3 during the emission period in each scan. The saturation state of the driving transistor T3 leads to the driving current through the driving transistor T3 to be proportional to a square of a difference between a gate-to-source voltage and the threshold voltage of the driving transistor.

Additionally, the emission-control sub-circuit 16 is configured to use the seventh transistor T7, controlled by the same emission-control signal from the third scan line EM, to determine a time span of passing the driving current from the second terminal D to the anode of the LED and flowing through the LED to its cathode coupled to the third voltage line $3^{rd}$_V=VSS (which is typically grounded to 0V), causing the LED to emit light. In particular, the time span of passing the driving current from the second terminal D to the LED equals to a pulse length of the emission-control signal from the third scan line EM at a turn-on voltage level, which is just the time span of the emission period with the light emission being driven by the driving current. Optionally, different emission period in different scan can have different time span. In an embodiment, the driving current is substantially compensated by the pixel circuit 100 as a fixed value independent from the threshold voltage of the driving transistor during the emission period.

In an embodiment, the driving current is controlled by the eighth transistor T8 to be ON or OFF based on the voltage level at the third node N3 as the path from the first voltage line to the first terminal is opened or closed, and further controlled by the seventh transistor T7 to be passed from the second terminal to the LED only in a time span of the emission period of each scan determined by the emission-control signal from the third scan line EM. Therefore, once there is a driving current flown via the driving transistor T3 through the LED, the light emission from the LED associated with a subject pixel in the display panel produces a partial pixel luminance that is solely determined by the length of the time span of the emission period. In other words, the partial pixel luminance can be quantified either as a value of zero (when no driving current is flown as the path from the first voltage line to the first terminal S is closed) or a value proportional to the time span in each emission period of the multiple scans. Accordingly, a full pixel luminance in one cycle for displaying one frame of image can be obtained by summing all the values of the partial pixel luminance cumulated over all emission periods of the multiple scans. As a result, the full pixel luminance supported by the pixel circuit 100 can be quantified to define different grayscale levels based on various combinations of individual partial pixel luminance produced by the LED in each of the multiple scans of applying the emission-control signal.

In an embodiment, all transistors in the FIG. 3 are provided as P-type thin-film transistors. For each P-type transistor, a low voltage level (such as VSS or a voltage below a threshold voltage Vth) applied to the gate electrode thereof is a turn-on voltage level to make the drain electrode and source electrode of the P-type transistor being conducted to each other. A high voltage level (such as a power supply voltage VDD or a voltage above a threshold voltage Vth) applied to the gate electrode thereof is a turn-off voltage level to disconnect the drain electrode from the source electrode.

Figure 4:
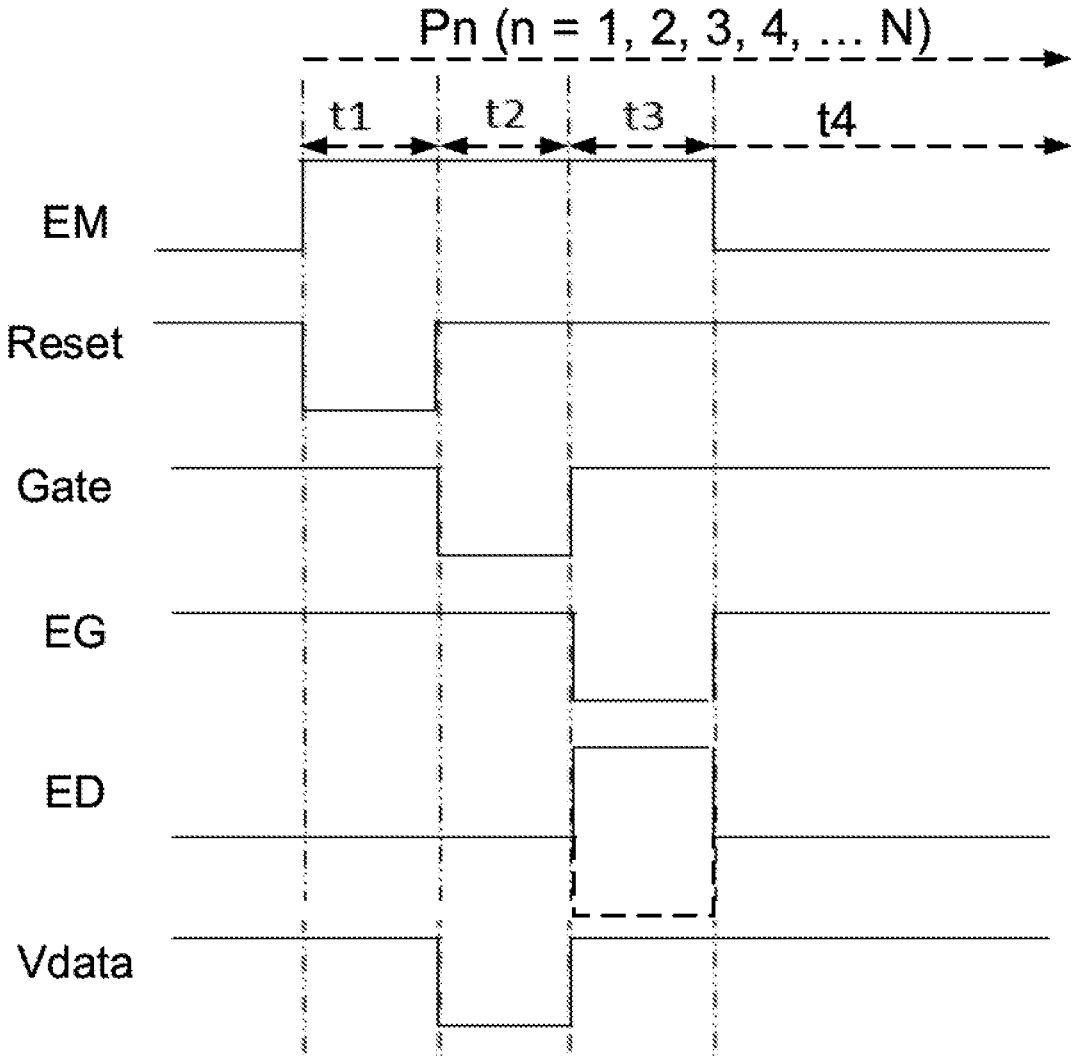
FIG. 4 is a timing waveform of several control signals used for driving the pixel circuit of FIG. 3 in each scan of a cycle for displaying one frame of pixel image according to an embodiment of the present disclosure.

In an example, the multiple scans of applying at least the emission-control signal EM in one cycle of displaying one frame of image include N numbers of scans. Here N is an integer greater than 1. In each scan associated with the emission-control signal from the third scan line EM, other control signals including the reset signal Reset, the gate-driving signal from the first scan line Gate, the gate-control signal from the second scan line EG, and the emission-drive signal from the emission-drive terminal ED are also provided to operating the pixel circuit 100. FIG. 4 is a timing waveform of several control signals used for driving the pixel circuit in one scan according to an embodiment of the present disclosure. Referring to FIG. 4, the scan is named Pn, n is selected from 1, 2, 3, 4, . . . N. Optionally, each scan includes sequentially a reset period t1, a data-input and compensation period t2, an emission-voltage setting period t3, and an emission period t4.

Referring to FIG. 3 and FIG. 4, operation of the pixel circuit 100 can be described by applying those control signals based on respective timing waveforms in each scan. Optionally, N different emission periods of respective N numbers of scans have N numbers of different time spans. Each of the N numbers of scans is sequentially arranged from one unit of time to $2^{N-1}$ units of time of a binary multiplication series. For each scan, the emission period t4 is just last part following the reset period t1, data-input-compensation period t2, and emission-voltage setting period t3, though t1, t2, or t3, can be substantially shorter than t4. For different scans in one cycle time, t4 is different. A sum of the N numbers of different time spans of all emission periods of the N numbers of scans is no greater than one cycle for displaying one frame of image.

For each scan, in the reset period t1, a reset signal Reset at a turn-on voltage level is supplied to the reset terminal as shown in FIG. 3 and FIG. 4. The first transistor T1, the fifth transistor T5, and the tenth transistor T10 are turned on by the reset signal in t1 to respectively reset voltage level at the first node N1 to Vinit, a voltage level at the second node N2 to VDD, and a voltage level at the third node N3 to Vinit. Optionally, Vinit can be a turn-on voltage level for a transistor. Optionally, Vinit=0V.

Next shown in FIG. 3 and FIG. 4, in the data-input-compensation period t2, a gate-driving signal at the turn-on voltage level is supplied to the first scan line Gate so that the second transistor T2 and the fourth transistor T4 are turned on. T4 is turn on so that the voltage at the second node N2 is changed to Vdata. The voltage level at the first node N1 is made to equal to that of the drain electrode D of the driving transistor T3. The voltage level at the third node N3 remains to be Vinit which turns the transistor T8 on to made the source electrode S of the driving transistor T3 to be VDD. A charging effect from the source electrode S to the drain electrode D pushes the drain electrode voltage to VDD+Vth (assuming the driving transistor is a p-type transistor), making the voltage level at the first node N1 also to be VDD+Vth, here Vth is threshold voltage of the driving transistor.

Next, in the emission-voltage setting period t3, the second scan line EG supplies the gate-control signal at the turn-on voltage level to turn on the ninth transistor 19. At the same period t3, in an example, the emission-drive signal ED is provided to the emission-drive terminal with a turn-off voltage level. The ninth transistor T9 is turned on during t3 to allow the turn-off voltage level to be written into the third node N3 so that the eighth transistor T8 is tuned off, i.e., with the source electrode S of the driving transistor T3 being disconnected from the first voltage line VDD. In this case, no driving current is able to flow through T3. In another example, the emission-drive signal ED is provided to the emission-drive terminal with a turn-on voltage level. Then, the ninth transistor T9 is turned on during t3 to allow the turn-on voltage level to be written into the third node N3 so that the eighth transistor T8 is turned on, i.e., with the source electrode S of T3 being connected to the first voltage line VDD. Under charge conservation law associated with the storage capacitor Cst connected between the first node N1 and the second node N2 and the capacitor C connected between the third node N3 and the first voltage line VDD, the voltage level at the second node N2 remains unchanged so does the first node N1. The voltage level of the third node N3 is also unchanged after it becomes floated.

Referring to FIG. 3 and FIG. 4, in the next emission period t4, the third scan line EM supplies a turn-on voltage level (in those three earlier periods t1, t2, and t3 of each scan, EM is provided with a turn-off voltage level) so that the seventh transistor T7 is turned on. If the third node N3 was written to a turn-off voltage level during t3, it will remain to be the turn-off voltage level in t4 so that the eighth transistor T8 is closed to have no driving current flown through T3. Even T7 is turned on, still no current flown to the LED and no light emission occurs. This is leads to a dark pixel image with grayscale level being the lowest level L0. If the third node N3 was written to a turn-on voltage level during t3, it will remain to be the turn-on voltage level in t4 so that the eighth transistor T8 is opened to allow the driving current to flown through T3. In the case, the driving transistor T3 is in a saturation state, yielding the driving current being substantially a fixed value. This driving current, when T7 is turned on, is passed to the LED to induce light emission from the LED, producing a partial pixel luminance depending on how long is the emission period t4. Whenever the seventh transistor T7 is opened by the emission-control signal EM during the emission period t4 in each scan and the emission-drive signal ED at the turn-on voltage is written into the third node N3 during the emission-voltage setting period t3 before the emission period t4 in the same scan.

Additionally, in the next emission period t4, the third scan line EM supplies the turn-on voltage level to turn on the sixth transistor T6 so that the second node N2 is connected to the first voltage line VDD. Therefore, in t4, the second node N2 is changed to VDD from the previous level of Vdata. Under the charge conservation law of the storage capacitor Cst, the voltage level of the first node N1 is changed to VDD+Vth+(VDD−Vdata)=2VDD−Vdata+Vth from the previous level of VDD+Vth. At the same emission period t4, it T8 is turned on the voltage level of the source electrode S of the driving transistor T3 will be VDD. The driving current of the driving transistor T3 can be obtained by following formula at the saturation state of T3, $I_d=K(Vgs-Vth)^2=K(2VDD-Vdata+Vth-VDD-Vth)^2=K(VDD-Vdata)^2$, where $K=\frac{1}{2}C_{ox}\mu W/L$ is a constant. Therefore, the driving current $I_d$ depends only on the voltage VDD supplied to the first voltage line VDD and the data signal Vdata but independent of the threshold voltage Vth of the driving transistor T3. When the first voltage line is supplied with a fixed voltage VDD, the driving current $I_d$ is only determined by the data signal Vdata.

Figure 5:
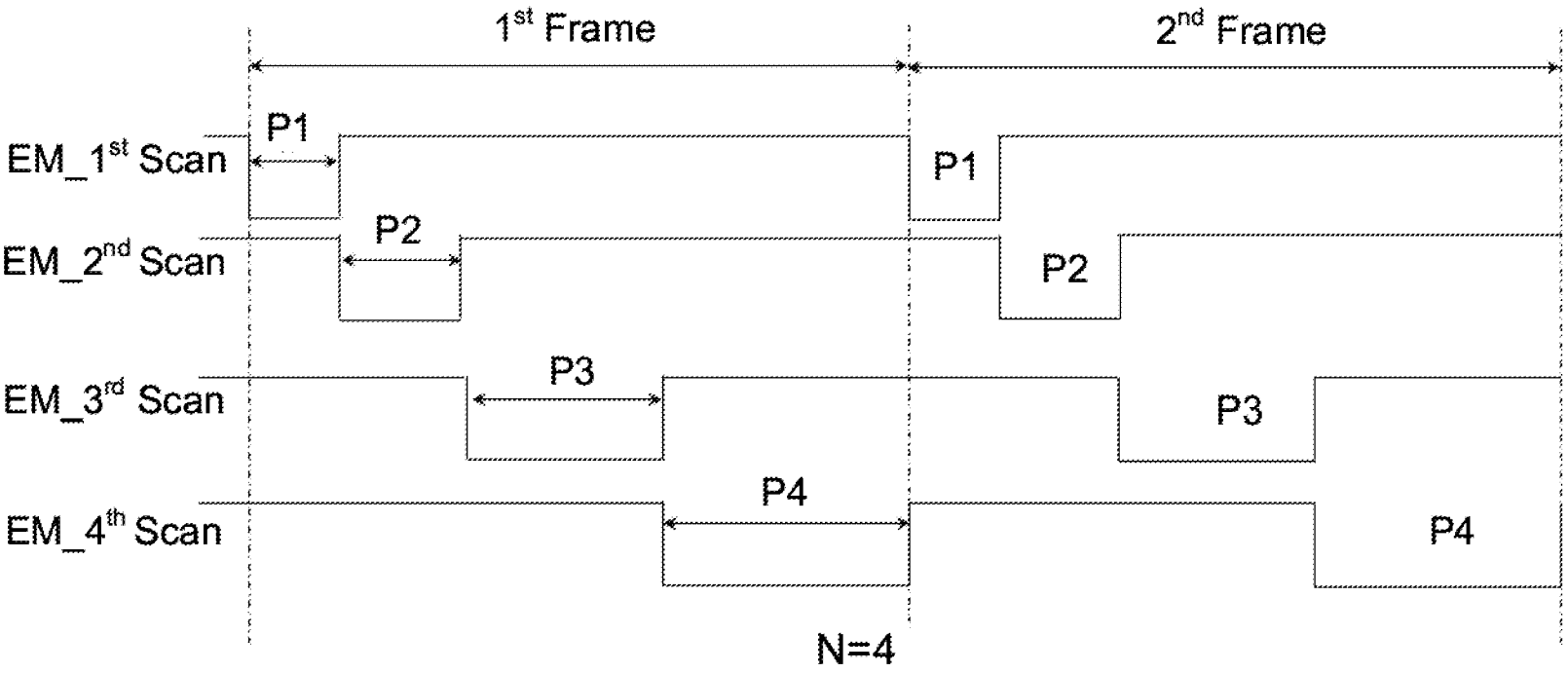
FIG. 5 is a timing diagram of applying an emission-control signal in multiple scans in each cycle for displaying one frame of pixel image according to an embodiment of the present disclosure.

FIG. 5 is a timing diagram of applying an emission-control signal in multiple scans in each repeated cycle for displaying one frame of pixel image after another according to an embodiment of the present disclosure. Referring to FIG. 5, unlike that there is only one effective emission period in one cycle of displaying one frame of pixel image under a conventional current driving scheme for the LED in each pixel, the present disclosure provides multiple effective emission periods in the one cycle time. Each effective emission period belongs to a separate scan for applying the emission-control signal EM to control the time span of the emission period for passing the driving current to the LED. Referring to FIG. 5, the emission-control signal EM is scanned four times, i.e., with sequential four scans P1, P2, P3, and P4, in one cycle of displaying one frame of image. Optionally, N numbers of scans Pn can be provided in one cycle time where n=1, 2, 3, 4, . . . , N.

For each scan Pn, the emission-control signal is provided with either a turn-on voltage level (e.g., low voltage in FIG. 5) in an emission period or a turn-off voltage level (high voltage in FIG. 5) in other periods before the emission period. Referring to FIG. 4 and FIG. 5, the emission-gate signal EG and the emission-drive signal ED are also scanned along with the emission-control signal EM in the N numbers of scans. In fact, each scan Pn includes the reset period t1, the data-input and compensation period t2, the emission-voltage setting period t3, and the emission period t4. For each scan Pn, before the emission-control signal from the third scan line EM is provided with the turn-on voltage level (FIG. 5) in the emission period t4, the Reset signal, the gate-driving signal from the first scan line Gate and the data signal Vdata from the data line, the gate-control signal from the third scan line EG and the emission-drive signal ED are also provided respectively in the reset period t1, the data-input-compensation period t2, and the emission-voltage setting period t3 as shown in FIG. 4.

In an embodiment, every time when the gate-control signal is scanned to the second scan line EG, the emission-drive signal ED at a certain voltage level, either a high voltage level or a low voltage level, will be written into the third node N3 based on requirement for achieving certain partial pixel luminance for the current scan. If the emission-drive signal ED is loaded as the high voltage level (e.g., a turn-off voltage) four times as the gate-control signal from the second scan line EG is scanned four times in P1, P2, P3, and P4 to close the path m the first voltage line to the first terminal, then every time no driving current can be generated, leading to a lowest level (zero) for the partial pixel luminance in every scan and cumulatively (over the four scans) corresponding to a lowest pixel grayscale level L0. If the emission-drive signal ED is loaded as the low voltage level (e.g., a turn-on voltage) four times as the gate-control signal from the second scan line EG is scanned four times in P1, P2, P3, and P4 to open the path from the first voltage line to the first terminal then every time there can be a driving current (depending only on the data signal) being generated, leading to light emission from the LED. The light emission has certain values for the partial pixel luminance depended on time spans of the driving current flowing through the LED in respective scans. Provided that the driving current is a fixed value in each scan, the partial pixel luminance depends on only the length of the time span of the corresponding emission period of each scan. Therefore, a cumulated pixel luminance over the four scans leads to a highest pixel grayscale level. If the emission-drive signal ED is loaded as a turn-on voltage level in some scans of the one cycle but as a turn-off voltage level in remaining scans of the same cycle, various pixel luminance can be generated to produce different grayscale levels between the lowest grayscale level L0 and the highest grayscale level.

In an embodiment, the N numbers of scans in one cycle is arranged such that N different emission periods of respective N numbers of scans have N numbers of different time spans. In a specific embodiment, each of the N numbers of different time spans is sequentially arranged from one unit of time to $2^{N-1}$ units of time of a binary multiplication series. In other words, the first scan includes a first emission period having a time span of a unit of time, e.g., P1. The second scan then includes a second emission period having a time spans equal to 2 units of time, e.g., P2=2P1. In general, $P(n+1)=2\times Pn=2^n\times P1$. In this arrangement for the numbers of time spans of the N numbers of scans in one cycle, the light emission driven by a fixed driving current is cumulated in the N numbers of time spans, yielding $2^N$ different pixel grayscale levels between the lowest level L0 and the highest level $L(2^{N-1})$.

For example, if the emission-control signal EM is scanned three times in one cycle, N=3, it yields 8 grayscale levels. Optionally, if the emission-control signal EM is scanned four times in one cycle, N=4, the pixel grayscale levels include 16 levels. Optionally, if EM is scanned 8 times in one cycle, N=8, the pixel grayscale includes 256 levels.

Figure 6:
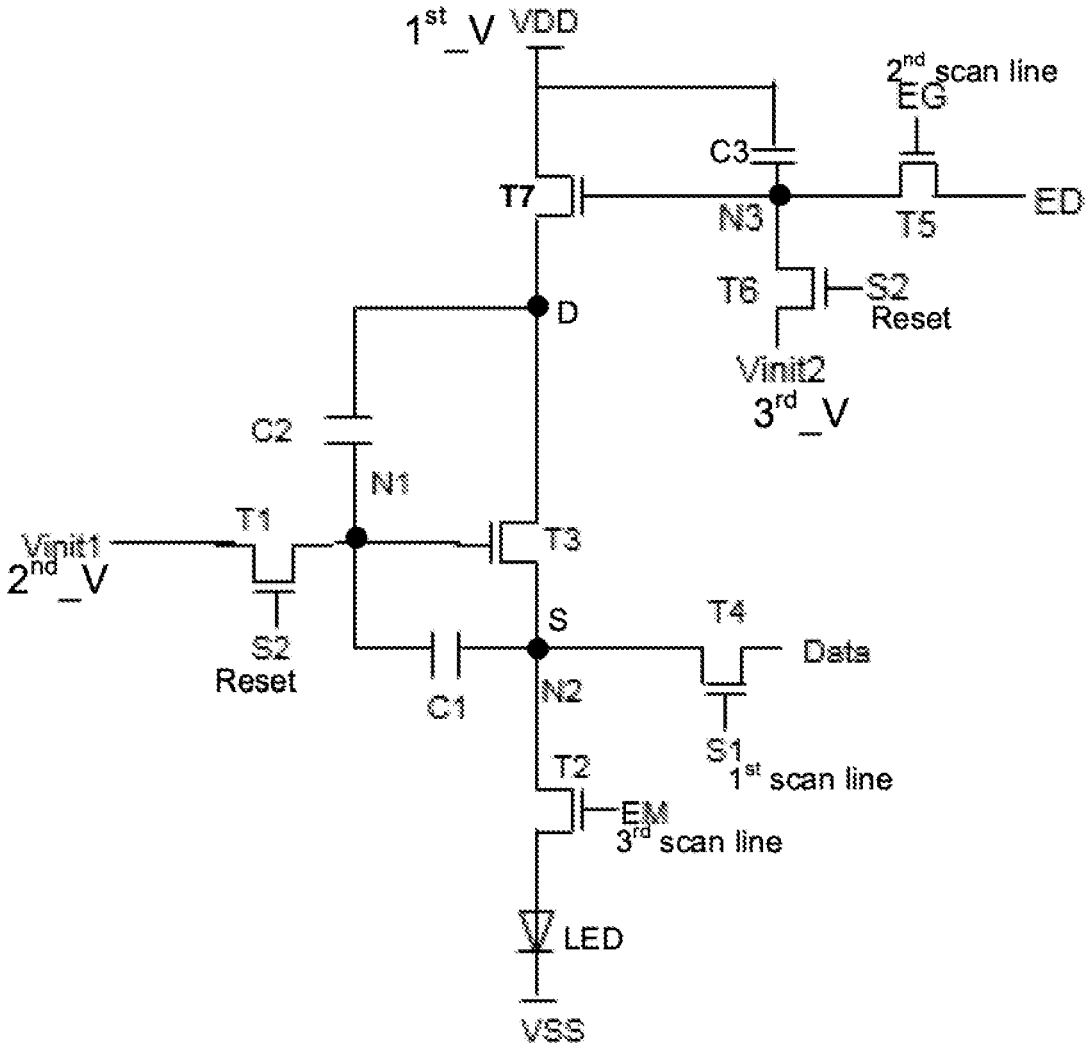
FIG. 6 is an exemplary circuit diagram of the pixel circuit according to another embodiment of the present disclosure.

In an alternative embodiment, the pixel circuit of FIG. 1 can be constructed using all N-type transistors to achieve substantially same functions of generating multiple grayscale levels by using a voltage-control sub-circuit and an emission-control sub-circuit to respectively control an ON/OFF state of a driving current path and various time spans to pass the driving current generated by a pixel sub-circuit. FIG. 6 is an exemplary circuit diagram of the pixel circuit according to another embodiment of the present disclosure. Referring to FIG. 6, the pixel circuit includes a driving transistor T3 having a drain electrode coupled to a first terminal D, a gate electrode connected to the first node N1, and a source electrode coupled to a second node N2 being also a second terminal S. The pixel circuit further includes a first storage capacitor C1 having a first electrode coupled to the first node N1 and a second electrode coupled to the second node N2. Additionally, the pixel circuit includes a first transistor T1 having a drain electrode coupled to the first node N1, a gate electrode coupled to a reset terminal S2 to receive a reset signal Reset in a reset period of each of the multiple scans in one cycle for displaying one frame of image, and a source electrode coupled to the second voltage supply to receive a first initializing voltage Vinit1. The pixel circuit further includes a second transistor T2 having a drain electrode coupled to the second node N2, a gate electrode coupled to the third scan line EM to receive an emission-control signal in an emission period of each of the multiple scans in one cycle for displaying one frame of image, and a source electrode coupled to the light-emitting diode LED. Furthermore, the pixel circuit includes a fourth transistor T4 having a drain electrode coupled to the second node N2, a gate electrode coupled to the first scan line S1, and a source electrode coupled to the data line Data provided with a data signal at least in a data-input-compensation period of each of the multiple scans in one cycle for displaying one frame of image. The pixel circuit also includes a fifth transistor T5 having a drain electrode coupled to an emission-drive terminal ED to receive an emission-drive signal, a gate electrode coupled to the second scan line EG to receive a gate-control signal in an emission-voltage setting period of each one of the multiple scans in one cycle for displaying one frame of image, and a source electrode coupled to the third node N3. Still, the pixel circuit includes a sixth transistor T6 having a drain electrode coupled to the third voltage supply Vinit2, a gate electrode coupled to the reset terminal S2 to receive the reset signal Reset in the reset period of each of the multiple scans in one cycle for displaying one frame of image, and a source electrode coupled to the third node N3. Moreover, the pixel circuit includes a seventh transistor T7 having a drain electrode coupled to the first voltage supply VDD, a gate electrode coupled to the third node N3, and a source electrode coupled to the first terminal D. Further, the pixel circuit includes a second storage capacitor C2 having a first electrode coupled to the first terminal D and a second electrode coupled to the first node N1 and a third storage capacitor C3 having a first electrode coupled to the first voltage supply VDD and a second electrode coupled to the third node N3. Optionally, each transistor herein is an N-type transistor. For each N-type transistor, a low voltage level (such as VSS or a voltage below a threshold voltage Vth) applied to the gate electrode thereof is a turn-off voltage level to make the drain electrode disconnected from the source electrode of the N-type transistor. A high voltage level (such as a power supply voltage VDD or a voltage above a threshold voltage Vth) applied to the gate electrode thereof is a turn-on voltage level to connect the drain electrode to the source electrode thereof.

Figure 7:
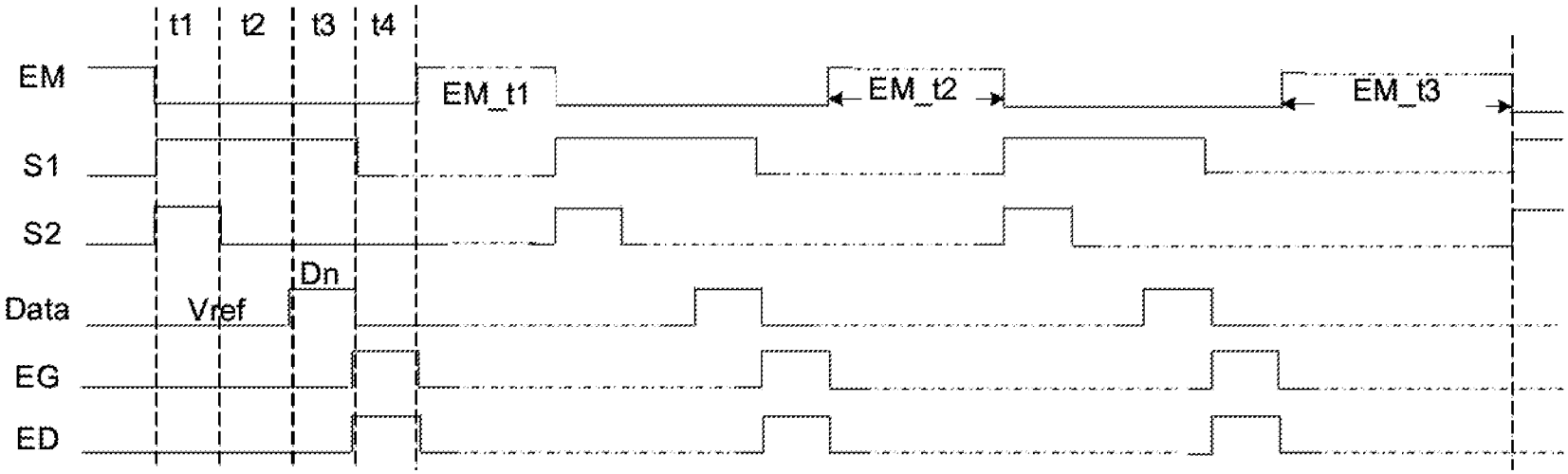
FIG. 7 is a timing waveform of several control signals used for driving the pixel circuit of FIG. 6 in each of three scans in one cycle for displaying one frame of pixel image according to a specific embodiment of the present disclosure.

FIG. 7 is a timing waveform of several control signals used for driving the pixel circuit of FIG. 6 in each of three scans in one cycle for displaying one frame of pixel image according to a specific embodiment of the present disclosure. Referring to FIG. 7, the driving scheme for each pixel circuit includes implementing multiple effective emission periods in one cycle for displaying one frame of pixel image. Each effective emission period belongs to a separate scan for applying an emission-control signal EM to control a time span of the corresponding emission period for passing the driving current from a second terminal of the pixel circuit of FIG. 6 to the light-emitting device (LED). Referring to an example shown in FIG. 7, the emission-control signal EM is scanned three times, i.e., with sequential three scans in one cycle. Optionally, each scan in one cycle includes sequentially a reset period t1, a retention period t2, a data-input period t3, a charging-compensation period t4, and an emission period EM_tn (n=1 for a first scan, n=2 for a second scan, . . . ).

Referring to FIG. 7, operation of the pixel circuit of FIG. 6 can be described by applying those control signals (emission-control signal EM, gate-driving signal S1, Reset signal S2, Data signal Data, gate-control signal EG, and emission-drive signal ED) based on respective timing waveforms in each scan. For each scan, the emission period EM_tn is just last part following the reset period t1, the retention period t2, the data-input period t3, and the charging-compensation period t4, though t1, t2, t3, or t4 can be substantially shorter than EM_tn. For different scans in one cycle, EM_tn is set different (i.e., EM_t1 is set to be different from EM_t2, and so on). A sum of the three corresponding time spans of the three emission periods of the three scans is no greater than one cycle for displaying one frame of image.

For each scan, in the reset period t1, a reset signal S2 at a turn-on (high) voltage level is supplied to the Reset terminal. The first transistor T1 and the sixth transistor T6 are turned on by the reset signal S2 in the reset period t1 to respectively reset a voltage level at the first node N1 to Vinit1 and a voltage level at the third node N3 to Vinit2. During the same period t1, a gate-driving signal S1 at the turn-on voltage level is also supplied to turn the fourth transistor T4 on to set a voltage level at the second node N2 at a reference voltage level Vref. Vinit2 can be set to be a turn-off voltage level so that the seventh transistor T7 is turned off to disconnect the third node N3 from the first voltage line VDD. Other control signals are at turn-off voltage levels.

Referring to FIG. 7, in the retention period t2, the gate-driving signal S1 is kept at the turn-on voltage level so that the fourth transistor T4 remains at ON state so is the voltage at the second node N2 retained at Vref. But the first transistor T1 is turned off as the reset signal S2 is dropped to a low voltage level to make the first node N1 floating at the voltage level Vinit1 and the sixth transistor T6 is also turned off to make the third node N3 floating at the Vinit2. A voltage difference between the first node N1 and the second node N2(Vref−Vinit1) is stored in the first storage capacitor C1. The seventh transistor retains OFF state to make the first terminal D floating at 0 V. Other control signals are at turn-off voltage levels. No driving current is generated in this period.

Referring to FIG. 7, in the data-input period t3, the gate-driving signal S1 is kept at the turn-on voltage level and the data line now is provided with a data signal Dn that is written to the second node N2. But the first first node N1 remains at floating state. Under charge conservation law associated with the first storage capacitor C1 connected between the first node N1 and the second node N2 which is also a source electrode of the driving transistor T3, the voltage level at the first node N1 is changed to Vinit1+Dn−Vref. If Vinit1=0V, the first storage capacitor C1 stores voltage difference of Dn−Vref. Other control signals remain at turn-off voltage levels. No driving current is generated in this period.

In the charging-compensation period t4, the gate-driving signal S1 is provided at the turn-off voltage level to turn the fourth transistor T4 off to make the second node N2 is floating state. During the period t4, a gate-control signal EG and an emission-drive signal ED are provided at turn-off voltage level so that the fifth transistor T5 is tuned on and a turn-on voltage level is written to the third node N3 to turn on the seventh transistor T7. The first terminal D is now connected to the first voltage line VDD. A charging current is able to flow from the first voltage line via the first terminal D through the driving transistor T3 to the second terminal S (or the second node N2). This current is internally compensated to eliminate its dependence from the threshold voltage Vth of the driving transistor T3.

In the next emission period EM_t1 (for the first scan), an emission-control signal EM is supplied with a turn-on voltage level so that the second transistor T2 is turned on to extend the current path from the second terminal S to the light-emitting device LED. The current flown through the driving transistor T3 also becomes a driving current flowing through the LED to drive the LED to emit light. The time span of emission period EM_t1, i.e., the time for the driving current to pass the second transistor T2 in the current scan, is determined by a pulse length of the emission-control signal EM. The time span of emission period EM_t1 determines how long the LED emits light, giving a corresponding partial pixel luminance. This partial pixel luminance can be zero corresponding to a lowest level if the emission-drive signal ED is set to a turn-off voltage level to keep the path from the first voltage line VDD to the first terminal D closed.

Referring to FIG. 7, after the first scan, a second scan of the cycle can be followed. In the second scan, it also includes similar periods to operate the pixel circuit of FIG. 6 to yield another partial pixel luminance in corresponding emission period EM_t2, which can be either a finite value (if the emission-drive signal ED is set to a turn-on voltage level) or zero (if the emission-drive signal ED is set to a turn-off voltage level). The partial pixel luminance in different scan can be different as the time span of the emission period EM_tn in n-th scan can be set to a different value. This further is repeated, with possible variation in corresponding partial pixel luminance value, for the third scan in the same cycle. At the end of the cycle, an effective pixel luminance is a cumulation of all partial pixel luminance in all three scans of the cycle. Based on variations of the choice of emission-drive signal ED being either at turn-on or turn-off voltage level and the pulse length of the gate-control signal EM being at the turn-on voltage level, multiple pixel luminance levels can be defined.

In another aspect, the present disclosure provides a display apparatus including a display panel having a plurality of pixels. Each of a plurality of pixels includes a light-emitting diode driven by a pixel circuit described herein to emit light. Optionally, the display panel is fabricated on a glass substrate. Optionally, the light-emitting diode is a micro light-emitting diode (μLED) based on the glass substrate. Optionally, the pixel circuit is configured to drive the μLED with a fixed driving current but to control different partial time spans of multiple scans in one cycle of displaying one frame of pixel image by applying several control signals in each of the multiple scans to achieve different pixel grayscale levels. The fixed driving current is independent of a threshold voltage associated with a driving transistor in the pixel circuit.

Optionally, the display apparatus further includes a first scan line configured to supply a gate-driving signal, a second scan line configured to supply an emission-gate signal, a third scan line configured to supply an emission-control signal, a data line for loading a data signal related to information of displaying a pixel image. Further, the display apparatus includes a first voltage supply configured to supply a first fixed voltage (typically a high voltage VDD as a main power supply), a second voltage supply configured to supply a second fixed voltage (typically a low voltage Vinit as an initializing voltage). Additionally, the pixel circuit includes, as shown in FIG. 3 in an example, driving transistor having a source electrode coupled to a first terminal, a gate electrode connected to the first node, and a drain electrode coupled to a second terminal. The pixel circuit further includes a storage capacitor having a first electrode coupled to the first node and a second electrode coupled to a second node. The pixel circuit additionally includes a first transistor having a source electrode coupled to the first node, a gate electrode coupled to a reset terminal to receive a reset signal in a reset period of each of the multiple scans in the one cycle for displaying one frame of image, and a drain electrode coupled to the second voltage supply. Further, the pixel circuit also includes a second transistor having a source electrode coupled to the first node, a gate electrode coupled to the first scan line to receive a gate-driving signal in a data-input-compensation period of each of the multiple scans in one cycle for displaying one frame of image, and a drain electrode coupled to the second terminal. The pixel circuit also includes a fourth transistor having a source electrode coupled to the second node, a gate electrode coupled to the first scan line, and a drain electrode coupled to the data line provided with a data signal at least in the data-input-compensation period. Further, the pixel circuit includes a fifth transistor having a source electrode coupled to the first voltage supply provided with a fixed high voltage, a gate electrode coupled to the reset terminal, and a drain electrode coupled to the second node. Additionally, the pixel circuit includes a sixth transistor having a source electrode coupled to the first voltage supply, a gate electrode coupled to the third scan line to receive an emission-control signal in an emission period of each of the multiple scans in one cycle for displaying one frame of image, and a drain electrode coupled to the second node. The pixel circuit further includes a seventh transistor having a source electrode coupled to the second terminal, a gate electrode coupled to the third scan line, and a drain electrode coupled to an anode of the light-emitting diode. Furthermore, the pixel circuit includes an eighth transistor having a source electrode coupled to the first voltage supply, a gate electrode coupled to the third node, and a drain electrode coupled to the first terminal. The pixel circuit still includes a ninth transistor having a gate electrode coupled to a second scan line to receive a gate-control signal in an emission-voltage setting period of each of the multiple scans in one cycle for displaying one frame of image, a source electrode coupled to an emission-drive terminal to receive an emission-drive signal, and a drain electrode coupled to the third node. Moreover, the pixel circuit includes a tenth transistor having a source electrode coupled to the third node, a gate electrode coupled to the reset terminal, and a drain electrode coupled to the second voltage supply provided with a fixed initializing voltage. The pixel circuit further includes a capacitor coupled between the first voltage supply and the third node for stabilizing a voltage level at the third node when the ninth transistor and the tenth transistor are turned off. Each of the transistor mentioned above is a P-type transistor.

Optionally, the display apparatus further includes a first scan line, a second scan line, a third scan line, a data line, a first voltage supply, a second voltage supply, and a third voltage supply. The pixel circuit includes a driving transistor having a drain electrode coupled to a first terminal, a gate electrode connected to the first node, and a source electrode coupled to a second node being also a second terminal. The pixel circuit further includes a first storage capacitor having a first electrode coupled to the first node and a second electrode coupled to the second node. The pixel circuit also includes a first transistor having a drain electrode coupled to the first node, a gate electrode coupled to a reset terminal to receive a reset signal in a reset period of each of the multiple scans in one cycle for displaying one frame of image, and a source electrode coupled to the second voltage supply. Additionally, the pixel circuit includes a second transistor having a drain electrode coupled to the second node, a gate electrode coupled to the third scan line to receive an emission-control signal in an emission period of each of the multiple scans in one cycle for displaying one frame of image, and a source electrode coupled to the light-emitting diode. The pixel circuit further includes a fourth transistor having a drain electrode coupled to the second node, a gate electrode coupled to the first scan line, and a source electrode coupled to the data line provided with a data signal at least in a data-input-compensation period of each of the multiple scans in one cycle for displaying one frame of image. Furthermore, the pixel circuit includes a fifth transistor having a drain electrode coupled to an emission-drive terminal to receive an emission-drive signal, a gate electrode coupled to the second scan line to receive a gate-control signal in an emission-voltage setting period of each one of the multiple scans in one cycle for displaying one frame of image, and a source electrode coupled to the third node. The pixel circuit further includes a sixth transistor having a drain electrode coupled to the third voltage supply, a gate electrode coupled to the reset terminal to receive the reset signal in the reset period of each of the multiple scans in one cycle for displaying one frame of image, and a source electrode coupled to the third node. Moreover, the pixel circuit includes a seventh transistor having a drain electrode coupled to the first voltage supply, a gate electrode coupled to the third node, and a source electrode coupled to the first terminal. The pixel circuit still includes a second storage capacitor having a first electrode coupled to the first terminal and a second electrode coupled to the first node and a third storage capacitor having a first electrode coupled to the first voltage supply and a second electrode coupled to the third node. Each transistor herein is an N-type transistor.

In another aspect, the present disclosure provides a method for driving a pixel circuit described herein in a light-emitting diode (LED) display panel. Optionally, this is a Micro LED display panel. The method includes a step of applying a gate-control signal to a second scan line to control an emission-drive signal being loaded to set a voltage at a third node for determining whether a path is open from a first voltage supply to a first terminal. Optionally, driving current is a fixed value if the data signal is fixed. The emission-drive signal is used to set a node voltage for operating a switch sub-circuit of the pixel circuit configured to determine whether a current path from the first voltage supply to a first terminal is opened. Additionally, the method includes a step of applying a gate-driving signal to a first scan line to control a data signal being loaded from a data line for setting a voltage level of a first node to determine a driving current flowing from the first terminal to a second terminal. Optionally, the driving current is internally compensated to remove its dependence on a threshold voltage or other electrical properties of a driving sub-circuit in the pixel circuit. Furthermore, the method includes a step of applying an emission-control signal to a third scan line to control a partial time span in each scan of multiple scans in the one cycle to pass the driving current from the second terminal to a light-emitting diode to drive the light-emitting diode to emit light only in the partial time span in each scan, wherein different scans of the multiple scans constitute different partial time spans arranged for quantifying a pixel luminance cumulated in the one cycle. Optionally, there is no driving current if the emission-drive signal operates the switch sub-circuit to shut off the path from the first voltage supply to the first terminal. In each cycle the emission-control signal is applied in each of multiple scans to set a time span of passing the driving current from the second terminal to the LED. Different scans in each cycle constitute different time spans which are arranged for quantifying a pixel luminance cumulated in the cycle.

In an embodiment, the method includes a step of resetting voltage levels at a first node, a second node, and a third node of the pixel circuit to initialize the voltage level at the control terminal of the driving sub-circuit directly through the first node and the voltage level of the first terminal of the driving sub-circuit indirectly through the third node in a reset period of each scan of the multiple scans before applying a gate-driving signal in a data-input and compensation period to load the data signal directly to the second node to adjust the voltage level at the control terminal and to connect the first node to the second terminal.

In the embodiment, the step of applying an emission-control signal includes supplying a turn-on voltage to turn on a voltage-control sub-circuit of the pixel circuit to load the emission-drive signal via an emission-drive terminal of the voltage-control sub-circuit at either a turn-on voltage or a turn-off voltage to the third node in an emission-voltage setting period after the data-input and compensation period of each scan. The emission-drive signal at the turn-on voltage operates the switch sub-circuit to determine the driving current with a fixed value is flowing through the driving sub-circuit or the emission-drive signal at the turn-off voltage operates the switch sub-circuit to determine no current is flowing through the driving sub-circuit.

In the embodiment, the step of applying an emission-control signal further includes adjusting the voltage level at the control terminal of the driving sub-circuit to determine the driving current independent of pixel characteristics in an emission period after the emission-voltage setting period of each scan. Optionally the driving sub-circuit is a thin-film MOS transistor having its gate electrode served as the control terminal, its source electrode served as the first terminal, and the drain electrode served as the second terminal and being set to a saturation state for allowing the driving current to flow from the first terminal to the second terminal. The driving current is further passed to the LED in a partial time span associated with the emission period in each scan for driving light emission to produce a partial pixel luminance over the partial time span. A pixel luminance can be obtained with one of multiple grayscale levels by adding the partial pixel luminance in each scan of the multiple scans in the one cycle time. Different partial time spans constitute a binary multiplication series starting from one unit of time in the first scan.

In a specific embodiment, the emission-control signal is scanned N numbers of times in each cycle time for displaying one frame of image to provide a turn-on voltage level in each emission period of each scan to pass the driving current to the LED to produce light emission over respective one of the N numbers of different time spans. The gate-control signal and the emission-control signal are respectively scanned to determine if the driving current being a constant current or no current each time before the emission-control signal is scanned in each emission period. As a result of the method, light emission cumulated in the N numbers of different time spans yields $2^N$ different pixel grayscale levels.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A pixel circuit for light-emitting diode display panel, comprising:

a voltage-control sub-circuit configured to set a voltage level for a third node based on an emission-drive signal under control of a gate-control signal;

a pixel sub-circuit coupled respectively to a first voltage supply and a data line to generate a driving current flown from the first voltage supply along a path via a first terminal to a second terminal, the path being opened from the first voltage supply to the first terminal by the voltage level at the third node; and an emission-control sub-circuit configured to set a time span of passing the driving current from the second terminal to a light-emitting diode under control of an emission-control signal in each of multiple scans of each cycle for displaying one frame of image;

wherein the multiple scans in one cycle of displaying one frame of image include N numbers of scans, N being an integer greater than 1; each of the N numbers of scans includes sequentially a reset period, a data-input-compensation period, an emission-voltage setting period, and an emission period; N different emission periods of respective N numbers of scans have N numbers of different time spans each of which being sequentially arranged from one unit of time to $2^{N-1}$ units of time of a binary multiplication series;

wherein a sum of the N numbers of different time spans of all emission periods of the N numbers of scans is no greater than one cycle for displaying one frame of image.

2. The pixel circuit of claim 1, wherein the pixel sub-circuit comprises:

a driving transistor having a source electrode coupled to a first terminal, a gate electrode coupled to a first node, and a drain electrode coupled to a second terminal;

a storage capacitor having a first electrode coupled to the first node and a second electrode coupled to a second node;

a first transistor having a source electrode coupled to the first node, a gate electrode coupled to a reset terminal to receive a reset signal in a reset period of each of the multiple scans in one cycle for displaying one frame of image, and a drain electrode coupled to a second voltage supply;

a second transistor having a source electrode coupled to the first node, a gate electrode coupled to a first scan line to receive a gate-driving signal in a data-input-compensation period of each of the multiple scans in one cycle for displaying one frame of image, and a drain electrode coupled to the second terminal;

a fourth transistor having a source electrode coupled to the second node, a gate electrode coupled to a first scan line, and a drain electrode coupled to a data line provided with a data signal at least in the data-input and compensation period;

a fifth transistor having a source electrode coupled to a first voltage supply provided with a fixed high voltage, a gate electrode coupled to the reset terminal, and a drain electrode coupled to the second node;

an eighth transistor having a source electrode coupled to the first voltage supply, a gate electrode coupled to the third node, and a drain electrode coupled to the first terminal; and a tenth transistor having a source electrode coupled to the third node, a gate electrode coupled to the reset terminal, and a drain electrode coupled to the second voltage supply provided with a fixed initializing voltage;

wherein the voltage-control sub-circuit comprises a ninth transistor having a gate electrode coupled to a second scan line to receive a gate-control signal in an emission-voltage setting period of each one of the multiple scans in one cycle for displaying one frame of image, a source electrode coupled to an emission-drive terminal to receive an emission-drive signal, and a drain electrode coupled to the third node;

wherein the emission-control sub-circuit comprises a sixth transistor having a source electrode coupled to the first voltage supply, a gate electrode coupled to a third scan line to receive an emission-control signal in an emission period of each one of the multiple scans in one cycle for displaying one frame of image, and a drain electrode coupled to the second node;

and a seventh transistor having a source electrode coupled to the drain electrode of the driving transistor, a gate electrode coupled to the third scan line, and a drain electrode coupled to an anode of the light-emitting diode;

wherein each transistor herein is a P-type transistor.

3. The pixel circuit of claim 1, wherein the pixel sub-circuit comprises:

a driving transistor having a drain electrode coupled to a first terminal, a gate electrode coupled to a first node, and a source electrode coupled to a second node being also a second terminal;

a first storage capacitor having a first electrode coupled to the first node and a second electrode coupled to the second node;

a first transistor having a drain electrode coupled to the first node, a gate electrode coupled to a reset terminal to receive a reset signal in a reset period of each of the multiple scans in one cycle for displaying one frame of image, and a source electrode coupled to a second voltage supply;

a fourth transistor having a drain electrode coupled to the second node, a gate electrode coupled to a first scan line, and a source electrode coupled to the data line provided with a data signal at least in a data-input-compensation period of each of the multiple scans in one cycle for displaying one frame of image;

a sixth transistor having a drain electrode coupled to a third voltage supply, a gate electrode coupled to the reset terminal to receive the reset signal in the reset period of each of the multiple scans in one cycle for displaying one frame of image, and a source electrode coupled to the third node;

a seventh transistor having a drain electrode coupled to the first voltage supply, a gate electrode coupled to the third node, and a source electrode coupled to the first terminal;

a second storage capacitor having a first electrode coupled to the first terminal and a second electrode coupled to the first node; and a third storage capacitor having a first electrode coupled to the first voltage supply and a second electrode coupled to the third node;

wherein the emission-control sub-circuit comprises: a second transistor having a drain electrode coupled to the second node, a gate electrode coupled to a third scan line to receive an emission-control signal in an emission period of each of the multiple scans in one cycle for displaying one frame of image, and a source electrode coupled to the light-emitting diode;

wherein the voltage-control sub-circuit comprises: a fifth transistor having a drain electrode coupled to an emission-drive terminal to receive an emission-drive signal, a gate electrode coupled to a second scan line to receive a gate-control signal in an emission-voltage setting period of each one of the multiple scans in one cycle for displaying one frame of image, and a source electrode coupled to the third node;

wherein each transistor herein is an N-type transistor.

4. A display apparatus comprising a display panel having a plurality of pixels, each of a plurality of pixels including a light-emitting diode driven by a pixel circuit of claim 1 to emit light in multiple scans of each cycle for displaying one frame of image.

5. The display apparatus of claim 4, further comprising:

a first scan line;

a second scan line;

a third scan line;

a data line;

a first voltage supply;

a second voltage supply;

the pixel circuit comprises:

a driving transistor having a source electrode coupled to a first terminal, a gate electrode coupled to a first node, and a drain electrode coupled to a second terminal;

a storage capacitor having a first electrode coupled to the first node and a second electrode coupled to a second node;

a first transistor having a source electrode coupled to the first node, a gate electrode coupled to a reset terminal to receive a reset signal in a reset period of each of the multiple scans in one cycle for displaying one frame of image, and a drain electrode coupled to the second voltage supply;

a second transistor having a source electrode coupled to the first node, a gate electrode coupled to the first scan line to receive a gate-driving signal in a data-input-compensation period of each of the multiple scans in one cycle for displaying one frame of image, and a drain electrode coupled to the second terminal;

a fourth transistor having a source electrode coupled to the second node, a gate electrode coupled to the first scan line, and a drain electrode coupled to the data line provided with a data signal at least in the data-input and compensation period;

a fifth transistor having a source electrode coupled to the first voltage supply provided with a fixed high voltage, a gate electrode coupled to the reset terminal, and a drain electrode coupled to the second node;

a sixth transistor having a source electrode coupled to the first voltage supply, a gate electrode coupled to the third scan line to receive an emission-control signal in an emission period of each one of the multiple scans in one cycle for displaying one frame of image, and a drain electrode coupled to the second node;

a seventh transistor having a source electrode coupled to the drain electrode of the driving transistor, a gate electrode coupled to the third scan line, and a drain electrode coupled to an anode of the light-emitting diode;

an eighth transistor having a source electrode coupled to the first voltage supply, a gate electrode coupled to the third node, and a drain electrode coupled to the first terminal;

a ninth transistor having a gate electrode coupled to a second scan line to receive a gate-control signal in an emission-voltage setting period of each one of the multiple scans in one cycle for displaying one frame of image, a source electrode coupled to an emission-drive terminal to receive an emission-drive signal, and a drain electrode coupled to the third node; and a tenth transistor having a source electrode coupled to the third node, a gate electrode coupled to the reset terminal, and a drain electrode coupled to the second voltage supply provided with a fixed initializing voltage;

wherein each transistor herein is a P-type transistor.

6. The display apparatus of claim 5, wherein the pixel circuit further comprises a capacitor coupled between the first voltage supply and the third node for stabilizing a voltage level at the third node when the ninth transistor and the tenth transistor are turned off.

7. The display apparatus of claim 4, further comprising:

a first scan line;

a second scan line;

a third scan line;

a data line;

a first voltage supply;

a second voltage supply;

a third voltage supply;

the pixel circuit comprises:

a driving transistor having a drain electrode coupled to a first terminal, a gate electrode coupled to a first node, and a source electrode coupled to a second node being also a second terminal;

a first storage capacitor having a first electrode coupled to the first node and a second electrode coupled to the second node;

a first transistor having a drain electrode coupled to the first node, a gate electrode coupled to a reset terminal to receive a reset signal in a reset period of each of the multiple scans in one cycle for displaying one frame of image, and a source electrode coupled to the second voltage supply;

a second transistor having a drain electrode coupled to the second node, a gate electrode coupled to the third scan line to receive an emission-control signal in an emission period of each of the multiple scans in one cycle for displaying one frame of image, and a source electrode coupled to the light-emitting diode;

a fourth transistor having a drain electrode coupled to the second node, a gate electrode coupled to the first scan line, and a source electrode coupled to the data line provided with a data signal at least in a data-input-compensation period of each of the multiple scans in one cycle for displaying one frame of image;

a fifth transistor having a drain electrode coupled to an emission-drive terminal to receive an emission-drive signal, a gate electrode coupled to the second scan line to receive a gate-control signal in an emission-voltage setting period of each one of the multiple scans in one cycle for displaying one frame of image, and a source electrode coupled to the third node;

a sixth transistor having a drain electrode coupled to the third voltage supply, a gate electrode coupled to the reset terminal to receive the reset signal in the reset period of each of the multiple scans in one cycle for displaying one frame of image, and a source electrode coupled to the third node;

a seventh transistor having a drain electrode coupled to the first voltage supply, a gate electrode coupled to the third node, and a source electrode coupled to the first terminal;

a second storage capacitor having a first electrode coupled to the first terminal and a second electrode coupled to the first node; and a third storage capacitor having a first electrode coupled to the first voltage supply and a second electrode coupled to the third node;

wherein each transistor herein is an N-type transistor.

8. A pixel circuit for light-emitting diode display panel, comprising:

a voltage-control sub-circuit configured to set a voltage level for a third node based on an emission-drive signal under control of a gate-control signal;

a pixel sub-circuit coupled respectively to a first voltage supply and a data line to generate a driving current flown from the first voltage supply along a path via a first terminal to a second terminal, the path being opened from the first voltage supply to the first terminal by the voltage level at the third node;

an emission-control sub-circuit configured to set a time span of passing the driving current from the second terminal to a light-emitting diode under control of an emission-control signal in each of multiple scans of each cycle for displaying one frame of image;

a reset sub-circuit coupled to the first voltage supply and a second voltage supply to initialize voltage levels at a first node, a second node, and the third node under control of a reset signal;

a data-input-compensation sub-circuit coupled to the first node and the second node to set the voltage level at the second node based on a data signal received from the data line under control of a gate-control signal provided in each of the multiple scans and adjust the voltage level at the first node based on the voltage level at the second node;

a switch sub-circuit coupled to the first voltage supply and a first terminal, and configured to turn ON or OFF for opening the path to connect the first voltage supply to the first terminal under control of the voltage level at the third node; and a driving sub-circuit coupled between the first terminal and the second terminal and configured to determine the driving current from the first terminal to the second terminal under control of the voltage level of the first node.

9. The pixel circuit of claim 8, wherein the pixel sub-circuit further comprises a storage sub-circuit coupled between the first node and the second node, the storage sub-circuit comprising a storage capacitor having a first electrode coupled to the first node and a second electrode coupled to the second node.

10. The pixel circuit of claim 8, wherein the driving sub-circuit comprises a driving transistor having a source electrode being the first terminal, a gate electrode coupled to the first node, and a drain electrode being the second terminal.

11. The pixel circuit of claim 8, wherein the reset sub-circuit comprises a first transistor having a source electrode coupled to the first node, a gate electrode coupled to a reset terminal to receive the reset signal in a reset period of each of the multiple scans, and a drain electrode coupled to the second voltage supply; a fifth transistor having a source electrode coupled to the first voltage supply, a gate electrode coupled to the reset terminal, and a drain electrode coupled to the second node; and a tenth transistor having a source electrode coupled to the third node, a gate electrode coupled to the reset terminal, and a drain electrode coupled to the second voltage supply.

12. The pixel circuit of claim 8, wherein the data-input-compensation sub-circuit comprises a second transistor having a source electrode coupled to the first node, a gate electrode coupled to a first scan line to receive a gate-driving signal in a data-input-compensation period of each of the multiple scans, and a drain electrode coupled to the second terminal; and a fourth transistor having a source electrode coupled to the second node, a gate electrode coupled to the first scan line, and a drain electrode coupled to a data line provided with the data signal at least in the data-input-compensation period;

wherein the second transistor is configured to set the voltage level at the first node to be equal to that at the drain electrode of the driving sub-circuit and the fourth transistor is configured to change the voltage level at the second node to that of the data signal received in the data-input-compensation period.

13. The pixel circuit of claim 8, wherein the voltage-control sub-circuit comprises a ninth transistor having a gate electrode coupled to a second scan line to receive the gate-control signal in an emission-voltage setting period of each of the multiple scans, a source electrode coupled to an emission-drive terminal to receive the emission-drive signal, and a drain electrode coupled to the third node, wherein the ninth transistor is configured to write a voltage level of the emission-drive signal to the third node during the emission-voltage setting period.

14. The pixel circuit of claim 13, wherein the switch sub-circuit comprises an eighth transistor having a source electrode coupled to the first voltage supply, a gate electrode coupled to the third node, and a drain electrode coupled to the first terminal, wherein the eighth transistor is configured, during the emission-voltage setting period, to either connect a source electrode of a driving transistor to the first voltage supply when the third node is at a turn-on voltage level passed from the emission-drive signal or disconnect the source electrode of the driving transistor from the first voltage supply when the third node is at a turn-off voltage level passed from the emission-drive signal.

15. The pixel circuit of claim 14, further comprising a capacitor coupled between the third node and the first voltage supply, the capacitor being configured to stabilize the voltage level at the third node at least in an emission period of each of the multiple scans after the emission-voltage setting period.

16. The pixel circuit of claim 15, wherein the emission-control sub-circuit comprises a seventh transistor having a source electrode coupled to the second terminal of the driving sub-circuit, a gate electrode coupled to a third scan line to receive the emission-control signal in the emission period of each of the multiple scans, and a drain electrode coupled to an anode of the light-emitting diode, wherein the seventh transistor is configured to pass the driving current from the drain electrode of the driving transistor to the light-emitting diode during the emission period in the time span set by the emission-control sub-circuit based on the emission-control signal.

17. The pixel circuit of claim 16, wherein the emission-control sub-circuit further comprises a sixth transistor having a source electrode coupled to the first voltage supply, a gate electrode coupled to the third scan line, and a drain electrode coupled to the second node, wherein the sixth transistor is configured to change the voltage level at the second node to a fixed voltage from the first voltage supply so that the voltage level at the first node is changed for determining the driving current during the emission period of each of the multiple scans.

18. A method for driving a pixel circuit in a light-emitting diode display panel, the pixel circuit having a voltage-control sub-circuit configured to set a voltage level for a third node based on an emission-drive signal under control of a gate-control signal; a pixel sub-circuit coupled respectively to a first voltage supply and a data line to generate a driving current flown from the first voltage supply along a path via a first terminal to a second terminal, the path being opened from the first voltage supply to the first terminal by the voltage level at the third node; and an emission-control sub-circuit configured to set a time span of passing the driving current from the second terminal to a light-emitting diode under control of an emission-control signal in each of multiple scans of each cycle for displaying one frame of image;

the method comprising:

applying a gate-control signal to a second scan line to control an emission-drive signal being loaded to set a voltage at a third node for determining whether a path is open from a first voltage supply to a first terminal;

applying a gate-driving signal to a first scan line to control a data signal being loaded from a data line for setting a voltage level of a first node to determine a driving current flowing from the first terminal to a second terminal;

applying an emission-control signal to a third scan line to control a partial time span in each scan of multiple scans in the one cycle to pass the driving current from the second terminal to a light-emitting diode to drive the light-emitting diode to emit light only in the partial time span in each scan, wherein different scans of the multiple scans constitute different partial time spans arranged for quantifying a pixel luminance cumulated in the one cycle; and resetting voltage levels at a first node, a second node, and a third node to initialize the voltage level at a control terminal directly through the first node and the voltage level of the first terminal indirectly through the third node in a reset period of each scan of the multiple scans before applying a gate-driving signal to the first scan line to load the data signal directly from the data line to the second node to adjust the voltage level at the control terminal and to connect the first node to the second terminal.

19. The method of claim 18, wherein applying an emission-control signal comprises supplying a turn-on voltage to load the emission-drive signal at either a turn-on voltage or a turn-off voltage to the third node in an emission-voltage setting period after a data-input-compensation period of each scan, wherein the emission-drive signal at the turn-on voltage determines the path is open for the driving current flowing to the second terminal or the emission-drive signal at the turn-off voltage determines the driving current is zero.

* * * * *